US009901190B2

(12) United States Patent
Resch

(10) Patent No.: US 9,901,190 B2
(45) Date of Patent: Feb. 27, 2018

(54) COOLING UNIT

(71) Applicant: AHT COOLING SYSTEMS GMBH, Rottenmann (AT)

(72) Inventor: Reinhold Resch, St. Peter (AT)

(73) Assignee: AHT COOLING SYSTEMS GMBH, Rottenmann (AT)

( * ) Notice: Subject to any disclaimer, the term of this patent is extended or adjusted under 35 U.S.C. 154(b) by 205 days.

(21) Appl. No.: 14/422,626

(22) PCT Filed: Aug. 6, 2013

(86) PCT No.: PCT/EP2013/066455
§ 371 (c)(1),
(2) Date: Feb. 19, 2015

(87) PCT Pub. No.: WO2014/029612
PCT Pub. Date: Feb. 27, 2014

(65) Prior Publication Data

US 2015/0230627 A1 Aug. 20, 2015

(30) Foreign Application Priority Data

Aug. 22, 2012 (DE) ..... 10 2012 107 712

(51) Int. Cl.
*A47F 3/04* (2006.01)
*F25D 17/06* (2006.01)

(52) U.S. Cl.
CPC ..... *A47F 3/0443* (2013.01)

(58) Field of Classification Search
CPC .... A47F 3/0443; A47F 3/0447; A47F 3/0452; A47F 3/0439; A47F 3/0482; A47F 3/0456; A47F 2003/046; F25D 23/023
(Continued)

(56) References Cited

U.S. PATENT DOCUMENTS 3,304,736 A * 2/1967 Brennan ..... A47F 3/0447 454/193
3,648,482 A * 3/1972 Beckwith ..... A47F 3/0447 62/256

(Continued)

FOREIGN PATENT DOCUMENTS

CA 676020 A 12/1963
CA 821 795 A 9/1969

(Continued)

OTHER PUBLICATIONS

European Patent Office, Form PCT/ISA/210, International Search Report for International Application No. PCT/EP2013/066455 in English, dated Oct. 30, 2013 (2 pages).

(Continued)

*Primary Examiner* — David Teitelbaum
*Assistant Examiner* — Joseph Trpisovsky
(74) *Attorney, Agent, or Firm* — Pauley Erickson & Kottis

(57) ABSTRACT

A cooling unit including a base group, a rear wall group and an upper group, defining a cooling chamber from below, the back and above, and are provided at least in part with components of a cooling device and which have a multi-layered structure with a flow channel arrangement embodied therein. In the base group as well as the rear wall group and the upper group intermediate spaces are formed between respective layers as parts of the flow channel arrangement, and an evaporator or another heat exchanger of the cooling device is arranged in a vertical intermediate chamber for generating cooling air.

30 Claims, 22 Drawing Sheets

(58) Field of Classification Search
USPC ..... 62/255, 256, 246, 419
See application file for complete search history.

(56) References Cited

U.S. PATENT DOCUMENTS

| | | | | |
|---|---|---|---|---|
| 4,633,677 | A * | 1/1987 | Maehara | A47F 3/0447 62/256 |
| 5,048,303 | A * | 9/1991 | Campbell | F25D 21/125 62/256 |
| 5,440,894 | A | 8/1995 | Schaeffer et al. | |
| 5,761,922 | A * | 6/1998 | Tamai | A47F 3/0447 62/256 |
| 7,966,843 | B2 * | 6/2011 | Lee | F25D 17/062 62/419 |
| 2005/0257548 | A1 * | 11/2005 | Grassmuck | A47F 3/0447 62/246 |
| 2006/0188365 | A1 * | 8/2006 | Haga | F04D 17/04 415/98 |
| 2007/0152551 | A1 * | 7/2007 | Kim | A47F 3/0482 312/401 |
| 2010/0313588 | A1 * | 12/2010 | Swofford | A47F 3/0443 62/251 |
| 2011/0302945 | A1 | 12/2011 | Howington et al. | |
| 2015/0208828 | A1 | 6/2015 | Resch | |

FOREIGN PATENT DOCUMENTS

| | | | |
|---|---|---|---|
| CN | 1935060 | A | 3/2007 |
| DE | 297 17 444 | U1 | 1/1998 |
| DE | 102 19 101 | A1 | 11/2003 |
| DE | 20 2006 007 152 | U1 | 9/2006 |
| DE | 10 2006 020 717 | B3 | 7/2007 |
| DE | 20 2010 008333 | | 11/2010 |
| EP | 0 696 893 | | 2/1996 |
| EP | 1 359 381 | A2 | 11/2003 |
| EP | 1 743 552 | A1 | 1/2007 |
| EP | 2 190 321 | A1 | 6/2010 |
| FR | 2 907 202 | A1 | 4/2008 |
| JP | S48-45596 | U | 6/1973 |
| JP | S51-125372 | U | 10/1976 |
| JP | S52-28053 | A | 3/1977 |
| JP | S58-20885 | U | 2/1983 |
| JP | S59-76973 | U | 5/1984 |
| JP | S61-3378 | | 1/1986 |
| JP | S62-105077 | A | 5/1987 |
| JP | H01-158092 | U | 10/1989 |
| JP | H04-110365 | U | 9/1992 |
| JP | H06-265255 | A | 9/1994 |
| JP | 2001-221561 | A | 8/2001 |
| TW | 382439 | U | 2/2000 |
| WO | WO 94/26154 | A1 | 11/1994 |
| WO | WO 2005/074749 | A1 | 8/2005 |
| WO | WO 2005/075910 | A1 | 8/2005 |
| WO | WO 2009/015674 | A1 | 2/2009 |
| WO | WO 2011/074993 | A1 | 6/2011 |
| WO | WO 2011/074994 | A1 | 6/2011 |
| WO | WO 2012/025240 | A2 | 3/2012 |
| WO | WO 2013/002849 | A1 | 1/2013 |

OTHER PUBLICATIONS

European Patent Office, Form PCT/ISA/237, Written Opinion of the International Searching Autority for Int'l Appln No. PCT/EP2013/066455, dated Oct. 30, 2013 (12 pages).

Co-pending U.S. Appl. No. 14/423,043, RESCH, Reinhold, "Cooling Device," filed Feb. 20, 2015.

* cited by examiner

COOLING UNIT

BACKGROUND OF THE INVENTION

Field of the Invention

This invention relates to a cooling unit having a base group, a rear wall group, and an upper group, which delimit a cooling chamber from below, the back, and above and are provided at least in part with components of a cooling device and which have a multilayered structure with a flow conduit system therein embodied. In the base group, the rear wall group, and the upper group, intermediate spaces are formed between respective layers as parts of the flow conduit system and in order to allow the air to circulate, the lower intermediate space formed in the base group, on the rear side thereof, is fluidically connected to a lower section of the vertical intermediate space formed in the rear wall group while the upper intermediate space formed in the upper group, on the rear side thereof, is fluidically connected to an upper section of the vertical intermediate space formed in the rear wall group, and an evaporator or another heat exchanger of the cooling device is situated or positioned in the vertical intermediate chamber for generating cooling air.

Discussion of Related Art

A cooling unit with such a flow conduit system is disclosed in Japanese Patent Reference JP H06-265 255 A. In this known cooling unit, an air flow produced by fans is conveyed in a flow circuit through a base group, a rear wall group, and an upper group as well as through an open front side of the cooling unit. An evaporator for producing the necessary cooling air is situated in the lower section of the rear wall group adjacent to the base group. In the flow direction upstream of the evaporator, a fan is positioned in a voluminous space of the base group. A part of the air flowing out through the evaporator in an upward direction is conveyed downward between its front side and the rear side of a wall section of the rear wall group and through the rear wall section into the interior of the unit that is to be cooled. A stratified air flow routing is produced in the rear wall group, the upper group, and partially also the base group. In such cooling units, achieving the most energy-efficient cooling possible poses problems. It is also necessary to take into account the most manageable design for installation and for the user.

A cooling unit disclosed in European Patent Reference EP 0 696 893 B1 is also shown with a flow conduit system extending through a base group, a rear wall group, and an upper group and across an open front region of the cooling unit that is embodied in a similar way to the cooling unit described above. Here, too, an evaporator is situated in the transition region between the base group and the rear wall group and a fan is positioned in the base group. The base group is likewise embodied as relatively voluminous.

Other cooling units with similar flow conduit systems are disclosed in Japanese Patent Reference JP 2001-221 561 A, Canadian Patent Reference CA 821 795 A, Chinese Patent Reference CN 1 935 060 A, Japanese Patent Reference JP S52-28 053 A, Japanese Patent Reference JP S62-105 077 A, Japanese Patent Reference JP S61-3 378 U, Taiwanese Patent Reference TW 382 439 U, Japanese Patent Reference JP S 59-76 973 U, Japanese Patent Reference JP S51-125 372 U, Japanese Patent Reference JP S58-20 885 U, Canadian Patent Reference CA 676 020 A, Japanese Patent Reference JP S48-45 596 U, Japanese Patent Reference JP H01-158 092 U, and Japanese Patent Reference JP H04-110 365 U.

German Patent Reference DE 20 2010 008 333 U1 discloses a cooling unit with a single-layer air flow in which a heat exchanger with an especially flat embodiment is situated above a blower system on an active wall in the lower region of the rear wall group. In the region of the base group, the air flow travels over the floor or over an insulation lying on the floor. In the rear wall, in the flow conduit, positioning rails are installed across the latter's layer thickness, in which shelf supports are hung.

Another cooling unit with a flow conduit system in a rear vertical region and in a lower and upper horizontal region is disclosed in PCT Patent Reference WO 2012/025 240 A2. In this known cooling unit, on the front side, warmed air that is guided into a lower horizontal sub-chamber is conveyed into a rear, vertical sub-chamber and in the latter, is conveyed through an evaporator in order to cool it. Part of the cool air exiting the top side of the evaporator is conveyed downward along the rear wall of the cooling chamber and via openings there, travels into the cooling chamber from the rear in order to cool the latter. Another partial flow of the air cooled by the evaporator travels into the upper sub-chamber and in the latter's front section, is conveyed downward through an opening in order to form a cooling air curtain and thus achieve a thermal insulation of the cooling chamber relative to the surrounding air. These measures make a significant contribution to improving the cooling conditions in the cooling unit. It is nevertheless difficult to achieve an optimum cooling function in a cooling unit.

SUMMARY OF THE INVENTION

One object of this invention is to provide a cooling unit of the type mentioned above but in which it is possible to improve the cooling properties with the most efficient possible use of cooling power and with a structurally favorable design.

This object and others are achieved with the features described in this specification and in the claims. In this case, at least one fan, particularly embodied in the form of a radial fan, is also provided at least in the vertical intermediate space in order to produce an air flow through the intermediate spaces.

This design of the rear wall group, base group, and upper group produces an advantageous envelope around the cooling chamber for an efficient cooling with good flow conditions.

In order to achieve the air flow routing and efficient cooling with an advantageous structural design, it is advantageous that the at least one fan, in particular a radial fan, is situated in the upper half of the vertical intermediate space above the evaporator or other heat exchanger. This achieves a uniform air flow through the gap between the vertically oriented fins of the evaporator without back pressure, which can occur when fans are situated beneath, and without the risk of an electrical malfunction or damage due to fluid dripping down.

The evaporator in this case, with its longitudinal axis extending horizontally along the rear wall, is preferably positioned relative to the vertical or a little above the middle region of the rear wall so that there is enough installation space on the rear wall above or below the heat exchanger, such as for fans or flow conduit elements.

An advantageous embodiment of the cooling unit, both in terms of the design and function, is that at least some sections of the vertical intermediate space are situated directly against the back side of a plate-shaped inner cover of the rear wall group adjoining the cooling chamber, at least some sections of the lower intermediate space are situated directly against the back side of a plate shaped floor cover adjoining the cooling chamber, and at least some sections of the upper intermediate space are situated directly against the top surface of a lower cover of the upper group adjoining the cooling chamber.

One advantageous air flow routing results from the upper intermediate space, via a slit-like outlet opening in a front top section, being brought into a fluidic connection with the lower intermediate space via a slit-like inlet opening in the front section of the base group in order, together with the upper intermediate space, the lower intermediate space, and the vertical intermediate space, to produce a circulating air flow by a front air curtain.

For the design and the cooling function, it is advantageous if in front of the evaporator or other heat exchanger, there is an open space for conveying away cooling air, which is produced in the evaporator or other heat exchanger and travels into the cooling chamber through distributed openings, in particular slots, in the inner cover.

Other features that are advantageous for the function and design relate to that on the side of the intermediate spaces oriented away from the cooling chamber, outer flow conduits are provided for stratified air flow routing. An outer vertical flow conduit is formed in the rear wall group between an outer casing and an intermediate partition that delimits at least some sections of the vertical intermediate space at the back. An outer lower flow conduit is formed on the inside of the deflector plate or in the base group between a deflector plate that delimits at least some sections of the lower intermediate space at the bottom and a base plate situated under it. An outer upper flow conduit is formed in the upper group between an upper cover of the upper group and an intermediate cover that delimits at least some sections of the upper intermediate space toward the top. The outer lower flow conduit is fluidically connected to a lower section of the vertical outer flow conduit while the outer upper flow conduit is fluidically connected to an upper section thereof in order to allow the air to circulate.

A stratified air flow routing is advantageously achieved if the outer upper flow conduit, via an outlet slit situated in the front top section, in front of the slit-like outlet opening, is brought into a fluidic connection with the outer lower flow conduit via an inlet opening extending along the front side in the front section of the base group in order, together with the outer upper flow conduit, the outer lower flow conduit, and the outer vertical flow conduit, to produce a circulating air flow by an outer front air curtain, which forms a warm air curtain relative to the, then inner, front air curtain forming a cold air curtain.

It is also advantageous for the design and function if to produce an air flow, at least one fan, in particular a radial fan, is situated at least in the vertical outer flow conduit, preferably in the lower region of the vertical outer flow conduit below the evaporator or other heat exchanger.

Also contributing to an advantageous design and a good air flow routing are the fact that the intermediate partition of the rear wall group has an intermediate wall that is mounted to the front side of the outer casing and spaced apart from it by vertical spacer strips and/or Z-shaped bends at its vertical edges. As a result of these features, the intermediate partition is attached in a stable fashion so that the evaporator or other heat exchanger, for example, can be advantageously mounted to its front side.

An advantageous thermal insulation of the cooling chamber with a simple, stable construction is provided if the outer casing of the rear wall group, the deflector plate of the base group, and the upper cover of the upper group are embodied in the form of thermally insulating plates.

One embodiment of the flow conduit system benefits if the outer lower flow conduit, possibly embodied with a plurality of branched individual conduits, is at least partially composed of at least one conduit that is molded into the deflector plate. The conduits in this case can be entirely embedded in the deflector plate, which is made out of foamed plastic, for example, or preferably can be molded into its underside, making it possible to achieve a selective air flow routing to the transition in the lower section of the outer vertical flow conduit in the rear wall group. For example, the deflector plate is produced in the form of a plastic sleeve that is blown into a mold with the flow conduit and is filled with the foamed plastic, such as PU foam, which then hardens and yields a stable, favorably insulating plate body.

One advantageous, stable design, such as in the form of a shelving module, is achieved if the rear wall group, the upper group, and the base group have plate-shaped wall elements, which are mounted to frame profiles of two side frames that laterally delimit a shelving module, with the adjacent narrow sides of the outer casing, the deflector plate, and the upper insulating cover protruding slightly beyond the lateral outsides of the side frames in order to produce a good thermal insulation between the narrow sides that are oriented toward one another.

In one advantageous embodiment, the side frames have a C-shaped form when viewed from the side, in the upper and lower end region of each rear vertical profile, a lower horizontal profile and an upper horizontal profile are respectively attached so that they protrude toward the front and the plate-shaped wall elements of the rear wall group are installed on the front side of the vertical profiles on both sides, the plate-shaped wall elements of the upper group are installed on the underside of the upper horizontal profiles, and the plate-shaped wall elements of the base group are installed between and/or on the lower horizontal frame profiles and, spaced apart from and in front of the vertical frame profiles, vertical support profiles are installed between the lower and upper horizontal frame profiles by a thermally insulating connection.

In other advantageous embodiments, the design and function result in the evaporator or other heat exchanger being fastened to the intermediate wall and also that when a plurality of fans are situated next to one another in the vertical intermediate space, an intermediate partition is installed between the fans in order to avoid or reduce a reciprocal negative flow influence such as short-circuiting.

A cooling unit system composed of or comprising a plurality of cooling units aligned next to one another and embodied in the form of shelving modules offers the user advantageous embodiment options. The transitions between the shelving modules along the adjacent narrow edges of at least the plate-shaped wall elements of the rear wall group are sealed by inserting sealing components. The shelving modules are in particular screwed to one another in adjacent frame profiles.

BRIEF DESCRIPTION OF THE DRAWINGS

This invention is explained in greater detail in view of exemplary embodiments with reference to the drawings, wherein.

DETAILED DESCRIPTION OF THE INVENTION

Figure 1:
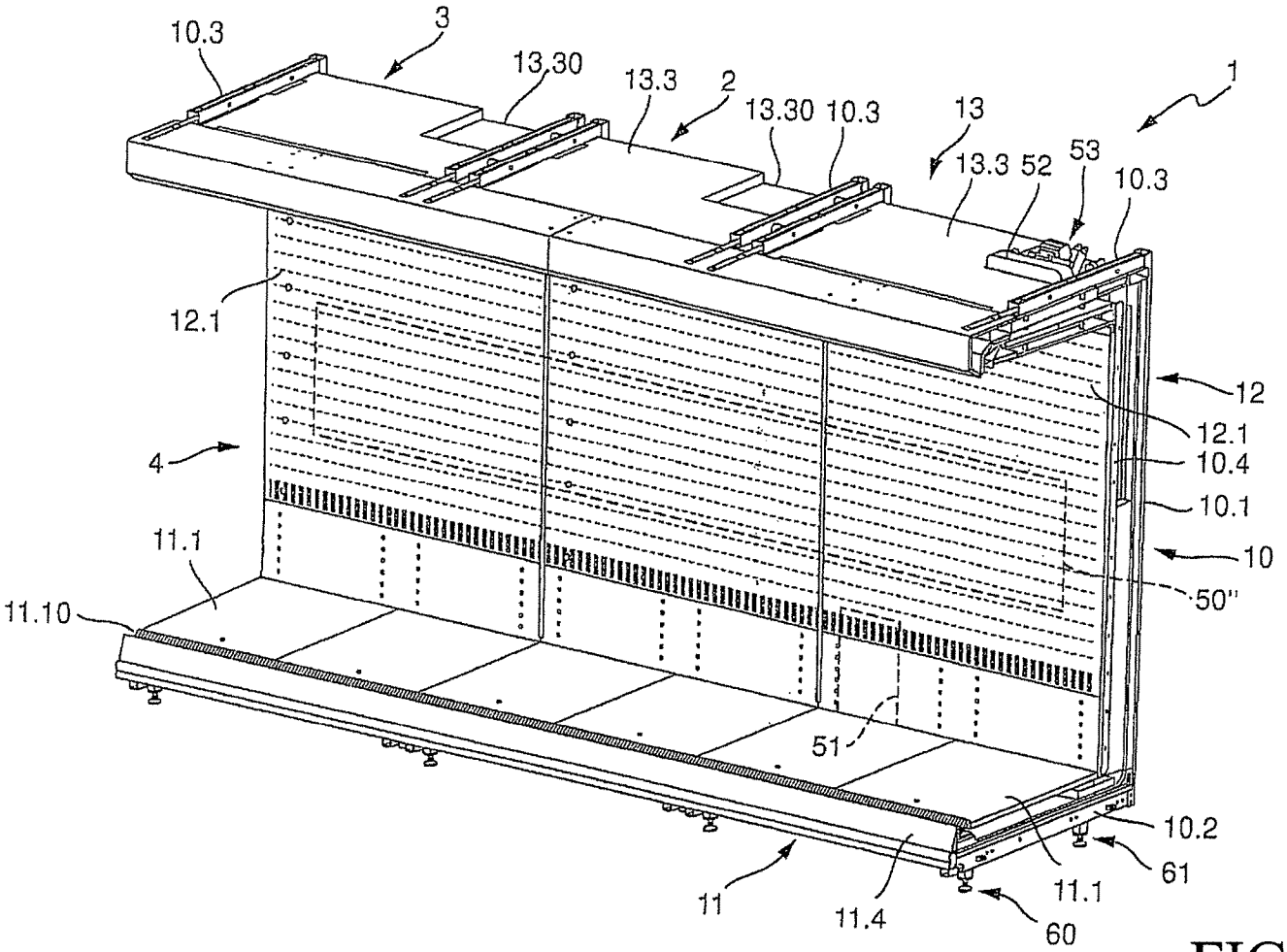
FIG. 1 shows three shelving modules aligned to form a cooling unit system, in the not yet fully assembled state, in a perspective view from the front and to the side.

FIG. 1 shows a unit composed of or comprising three shelving modules 1, 2, 3 combined into a cooling unit system. The cooling unit system encloses a frontally accessible cooling chamber 4 at the back, from above and below, and at least when in use, also from the side, for which purpose the two corresponding side walls are mounted on both sides of the system. The front side can be open and freely accessible or for special applications, can be provided with door elements. When in use, shelves are mounted in the cooling chamber 4, onto which the chilled goods, such as meats, dairy products, or the like, are placed in a sales room. A single shelving module 1, 2, 3 can be used as a cooling unit. Side walls can be mounted on both sides and the front side can be open or can be closed by at least one door element.

Figure 2:
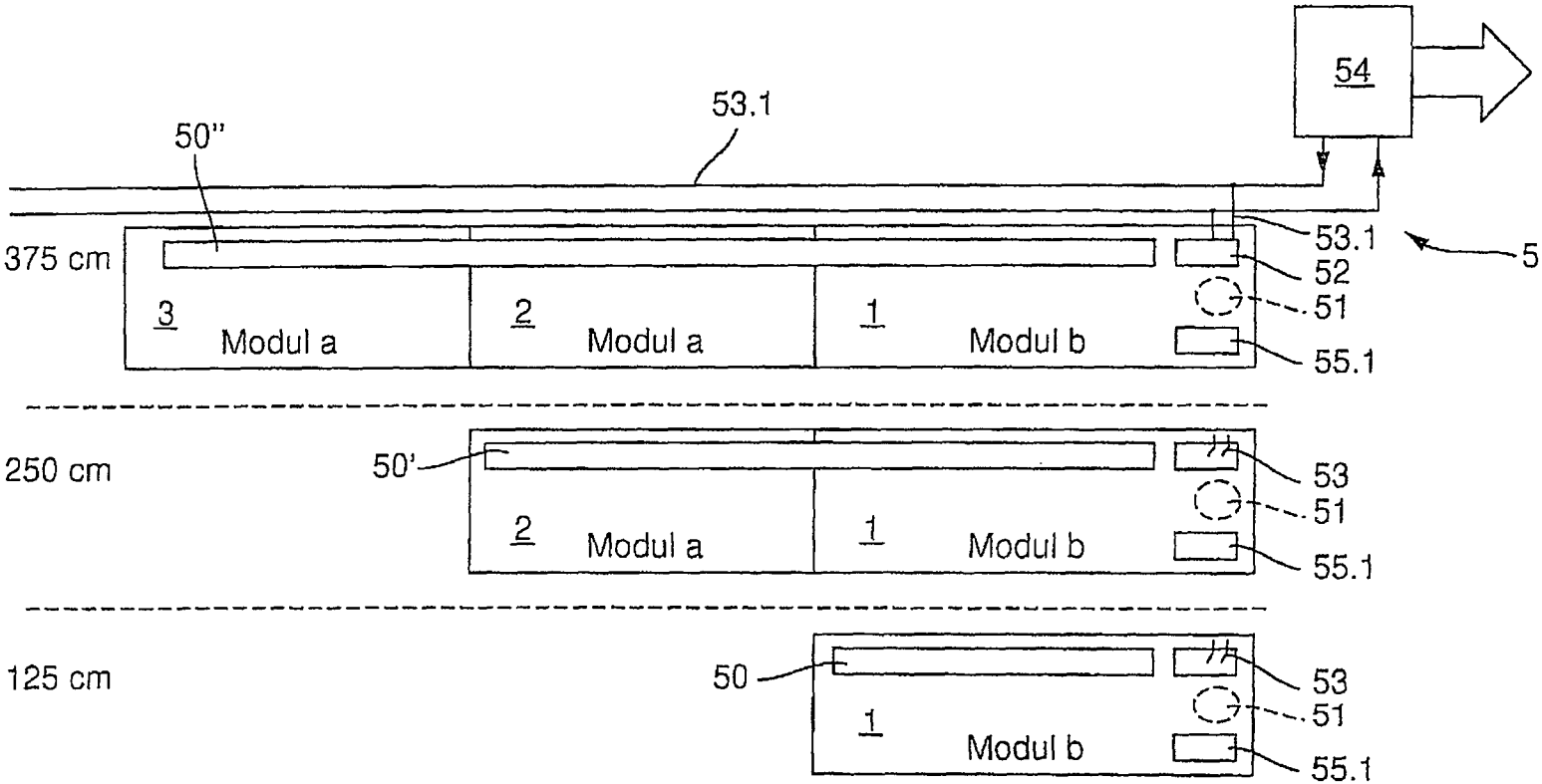
FIG. 2 is a schematic view of three cooling unit systems including one shelving module, two shelving modules, and three shelving modules, respectively, with schematically depicted components of a cooling device with a connection to a central heat exchanger.
Figure 3:
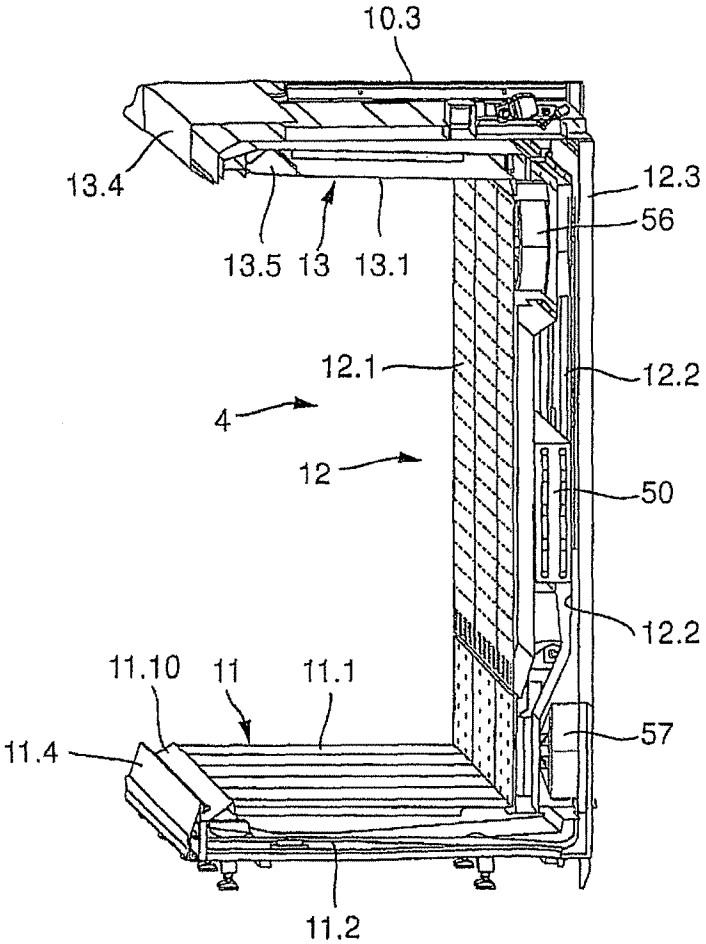
FIG. 3 shows a perspective view of a shelving module obliquely from the front and to the side in a depiction in which it is open at the side.

To keep the cooling chamber 4 cold, components of a cooling device 5 are integrated into the cooling unit system (see FIG. 2), in particular an evaporator 50, 50', 50", a compressor 51, a condenser 52, an expansion valve device, connectors 53 including connecting lines 53.1, and a control unit 55.1 of a control system 55 (see FIG. 8), as well as fans 56, 57 for producing or assisting required air flows (see FIG. 3). The condenser 52 can be connected by corresponding connecting lines 53.1 via a secondary circuit to a heat exchanger 54, such as located in another space. If necessary, it is also possible, for example, for a larger cooling unit system to include a plurality of such components of the cooling device 5.

In one version of the exemplary embodiment shown, the condenser 52 with corresponding connectors 53 is situated or positioned in or on an upper group 13 in an upper cooling component recess 13.30 situated there in the region of an upper cover 13.3 so that it is easily accessible from above or behind, while the compressor 51 is preferably situated in the lower region of a rear wall group 12, behind an inner cover 12.1 that delimits the cooling chamber 4 at the back, in a receiving space (not shown in detail) of a receiving device. In the middle region of the rear wall group 12, the evaporator 50, 50', 50" is likewise situated behind the inner cover 12.1 and is mounted with the receiving device. As clear from FIG. 1, the evaporator 50" extends continuously across all three shelving modules 1, 2, 3, while the compressor 51 and condenser 52 for all three shelving modules 1, 2, 3 of the cooling unit system are jointly situated in only one shelving module 1, in the exemplary embodiment according to FIG. 1 in the one on the right, and are connected to the evaporator 50" via corresponding connecting lines with the interconnection of relevant intermediate elements of the cooling device 5 such as expansion valves or restrictors.

Aside from the upper group 13 and rear wall group 12 mentioned above, each shelving module 1, 2, 3 also has a base group 11. With a floor cover 11.1 situated on top, it delimits the bottom of the cooling chamber 4 and at its front, has a covering grating 11.10, which is provided with air passage holes, in particular air passage slots, and a front cover 11.4 with a protective or decorative molding in the front edge region.

Essential components of each shelving module 1, 2, 3 are the side frames 10 situated on each side, which have a C-shaped form when viewed from the side, with a vertical profile 10.1 along the back side, a lower horizontal profile 10.2 connected to the vertical profile at the bottom and extending toward the front, and an upper horizontal profile 10.3 connected to the upper end section of the vertical profile 10.1 and extending toward the front. In the depiction shown, the lower horizontal profile 10.2 extends farther forward than the upper horizontal profile 10.3. Further testing, however, has shown that an upper profile 10.3 that is exactly as long as or longer than the lower horizontal profile 10.2 can be advantageous, for example, to support a front part with a roller curtain and lighting system in a stable fashion, without flexing. A support profile 10.4 is installed in front of the vertical profile 10.1, spaced apart from it toward the front, between the lower and upper horizontal profile 10.2, 10.3. The lower horizontal profile 10.2 is supported on height-adjustable feet 60, 61. The two side frames 10 of each shelf module 1, 2, 3 support the base group 11 by their lower horizontal profiles 10.2, support the rear wall group 12 by their vertical profiles 10.1 and support profiles 10.4, and support the upper group 13 by their upper horizontal profiles 10.3 and produce a stable structure with simple assembly steps. They also make it possible to align a plurality of shelving modules 1, 2, 3 next to one another in a stable fashion to form the cooling unit system, it thus being possible to transport the cooling unit system as a stable unit by a hoisting device or vehicle.

As shown in FIG. 2, an advantageous exemplary embodiment of a cooling unit system comprises only one shelving module 1 with all of the components of a cooling device except for the possibly provided central heat exchanger 54, with relevant connecting lines 53.1 leading back and forth (module of design type b), while the other shelving modules of a cooling unit system are only provided with an evaporator 50, 50', 50", with the evaporator 50', 50" advantageously but not necessarily being embodied in the form of a continuous unit (modules of design type a). The evaporator in modules of design type a is connected via corresponding connectors 53 including connecting lines 53.1 and possibly electrical cabling for a signal transmission (sensors, control) and electrical energy supply to the remaining relevant components of the cooling device in the shelving module 1 of design type b. All of the shelving modules 1, 2, 3, however, are prepared in the same way for accommodating all of the required components of the cooling device 5 and also with pre-installed sections of the connecting lines 53.1 and connectors for a fast, easy connection between the cooling components of the shelving modules and possibly with the central heat exchanger 54 so that with little assembly effort, modules of one design type can be converted into a module of the other design type or possibly even of yet another design type with different or additional components of the cooling device. It is also possible, for example in a cooling unit system with a large number of shelving modules, for there to be more than only one shelving module of design type b or of a design type with additional components of the cooling device.

An evaporator 50', 50" extending across a plurality of shelving modules 1, 2, 3 can also be subsequently inserted with relative ease between the relevant vertical profiles 10.1 and support profiles 10.4 that are spaced apart from them and fastened to the vertical profiles and/or to an intermediate partition, in particular an intermediate wall 12.2. The subsequent installation takes place, for example, by inserting the heat exchanger, in particular the evaporator 50, 50', 50", from a side parallel to the plane of the rear wall or from the front, after the removal of relevant support profiles 10.4, which are then reinstalled. As described in greater detail below, the particular assembly method of the support profiles 10.4 permits a simple installation and removal.

As evident from FIG. 2, with the design shown, only one shelving module 1 needs to be connected to the central heat exchanger 54 with the prepared connectors 53, which include quick couplings and controllable valves, for example, while the other shelving modules 2, 3 need only be simply connected to one another via the integrated connector 53. In this case, the central heat exchanger 54 is generally connected via a secondary circuit to the condenser 52 of the relevant shelving module 1 (design type b). A different refrigerant is used in the secondary circuit than in the cooling unit system. For example, a compact plate- or tube heat exchanger can be used for the condenser 52. In the central heat exchanger 54, incoming heat can be removed for another use of the thermal energy, as indicated by the arrow at the top right.

Figure 4:
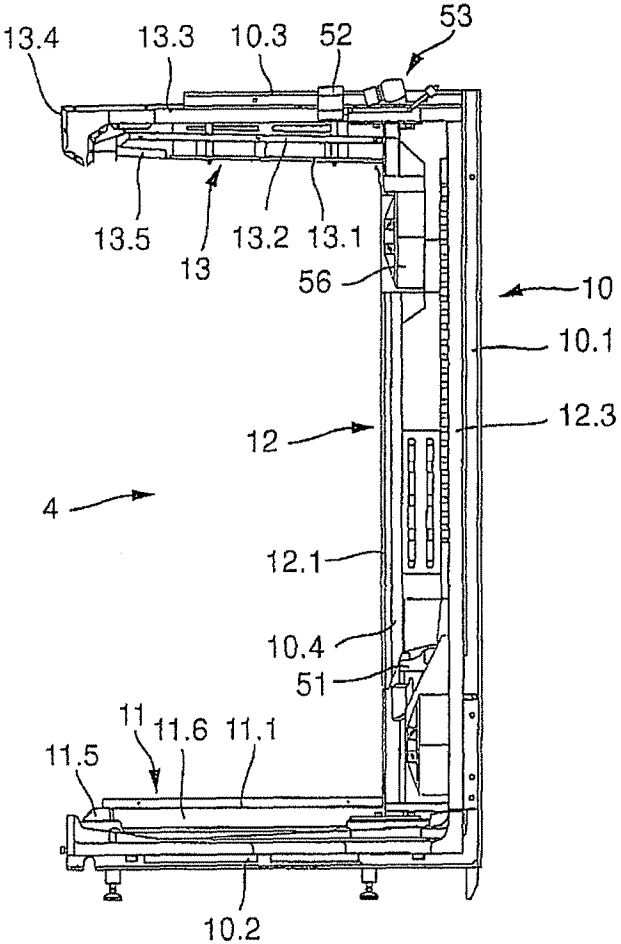
FIG. 4 shows an open side view of a shelving module.
Figure 10:
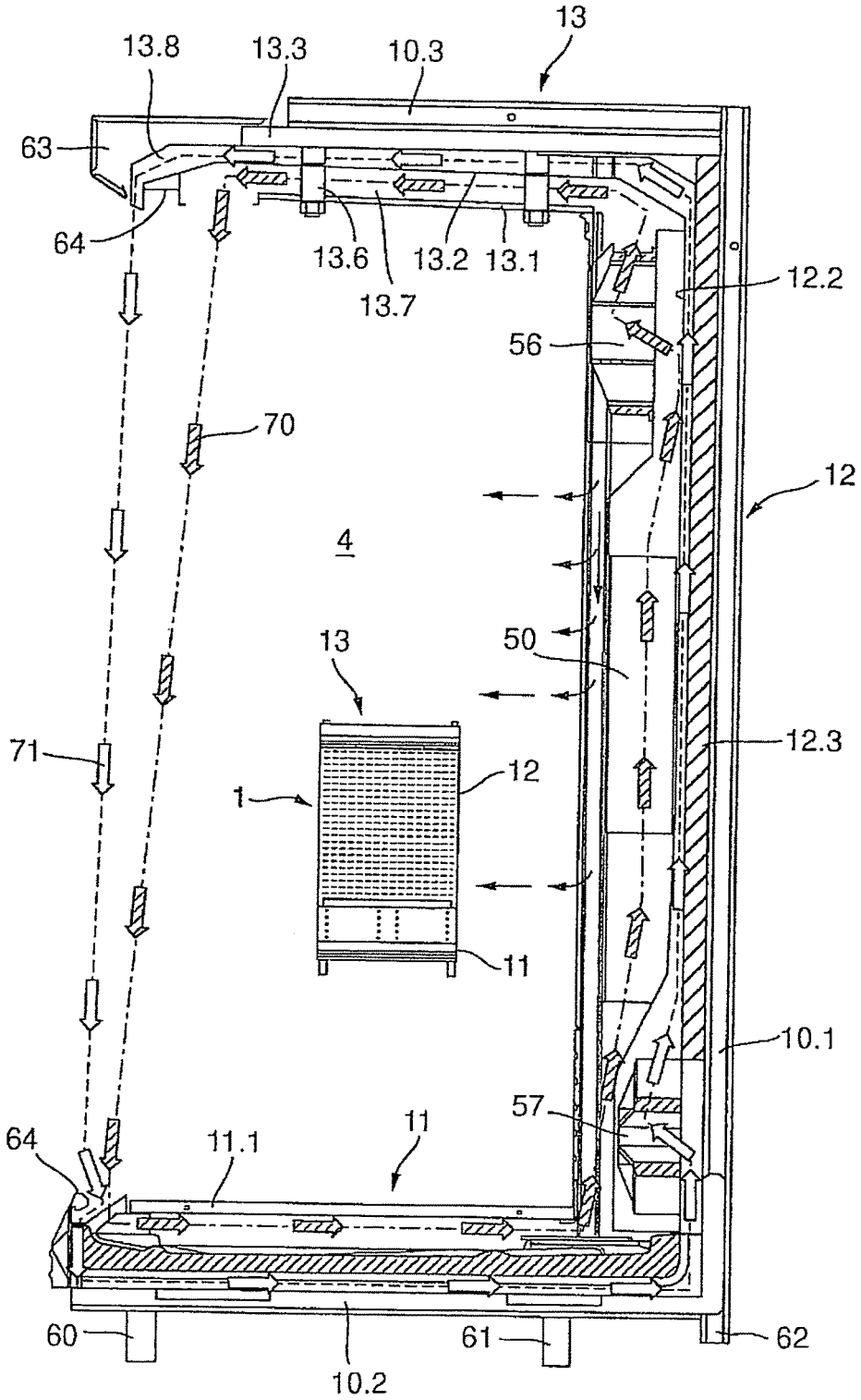
FIG. 10 shows a schematic view of a shelving module in a cross-section viewed from the side.

As shown in FIGS. 3 and 4, the base group 11, the rear wall group 12, and the upper group 13 are embodied of multiple layers with intermediate spaces embodied therein for the air flow routing. The air flow routing is produced or assisted by fans 56, 57, which are embodied in the form of radial fans or diagonal fans and of which, in the exemplary embodiment shown, one is situated in the lower region of the rear wall group 12 and one is situated in its upper region or alternatively two are situated in the upper region of the rear wall group 12. The upper fan or fans 56 in this case each produces the air flow through the evaporator 50, 50', 50" from bottom to top, as indicated in FIG. 10. An intermediate fan partition 59 (see FIG. 8) can be installed between the fans 56 in order to avoid or reduce a reciprocal negative flow influence such as short-circuiting. In this case, a part of the cooling air flow produced by the evaporator 50, 50', 50" conveyed farther downward on the back side of the inner cover 12.1 and flows through the ventilation slots provided in the inner cover 12.1 into the cooling chamber 4 in order to keep the latter at the required refrigeration temperature. In order to achieve an optimum cooling, this cooling air flow that is conveyed into the cooling chamber 4 can be fanned out and suitably adapted, for example by reducing the flow resistance toward the bottom. Another part of the cooling air flow is conveyed via the upper fan(s) 56 through the vertical inner intermediate space 12.4 of the rear wall group 12 into an upward intermediate space 13.7 connected thereto in the upper group 13, along the top of a lower cover 13.1 that delimits the cooling chamber 4 at the top, to a front top section 13.4, where at the underside of the latter, it emerges from a slit-like outlet opening 13.50 with an outlet grating 13.5 and forms a cold air curtain 70 on the front side (see FIG. 10). In the front region of the base group 11, the air flow of the cold air curtain 70 then travels through an inlet opening 11.11 which is provided there, is covered by a covering grating 11.10, and extends along the front side and back into the intermediate space 11.6 below the floor cover 11.1 in order to then once again flow through the inner vertical intermediate space 12.4 of the rear wall group 12 fluidically connected to it in the circuit through the evaporator and the upper fan 56. In order to ensure a good transmission of the cooling power toward the cooling chamber 4, the floor cover 11.1, the inner cover 12.1, and the lower cover 13.1 of the upper group 13 are composed of or comprise thin-walled plates, in particular of metal or plastic, which are also easy to handle and clean. The plates of the floor cover 11.1 are advantageously segmented in the width direction and extend from the inlet opening 11.11 in the frontal region of the base group 11 to the lower region of the inner cover 12.1 of the rear wall group 12. The plates of the inner cover 12.1 of the rear wall group 12 are advantageously segmented in the vertical direction and extend across the entire width between the two side frames 10 of a shelving module 1, 2, 3. A plurality of plates situated one on top of the other vertically can be inserted or removed in an easily maneuverable way in order to uncover, clean, install, or remove relevant components of the cooling device 5.

Figure 5:
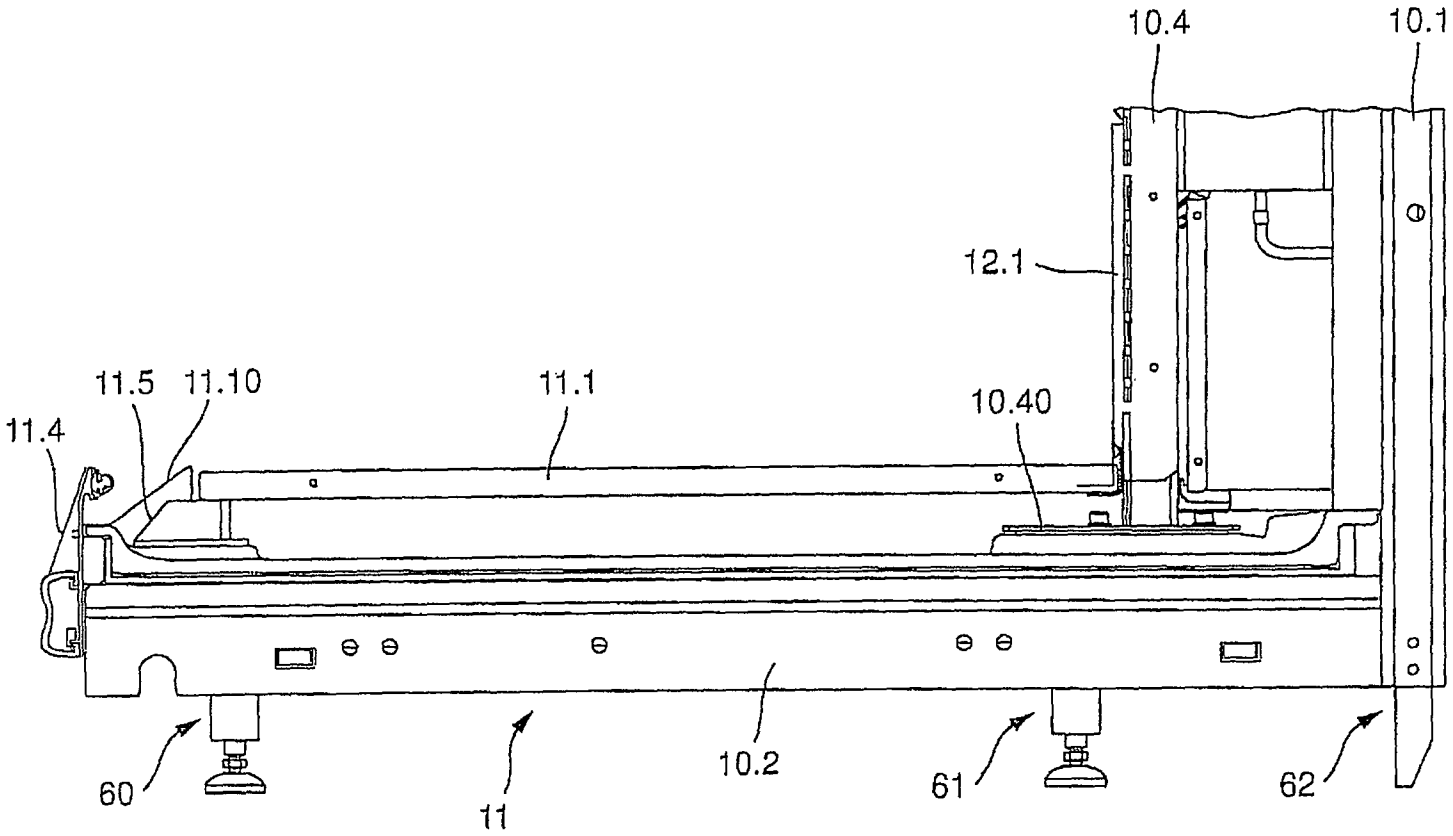
FIG. 5 shows an open side view of a lower section of a shelving module.
Figure 6:
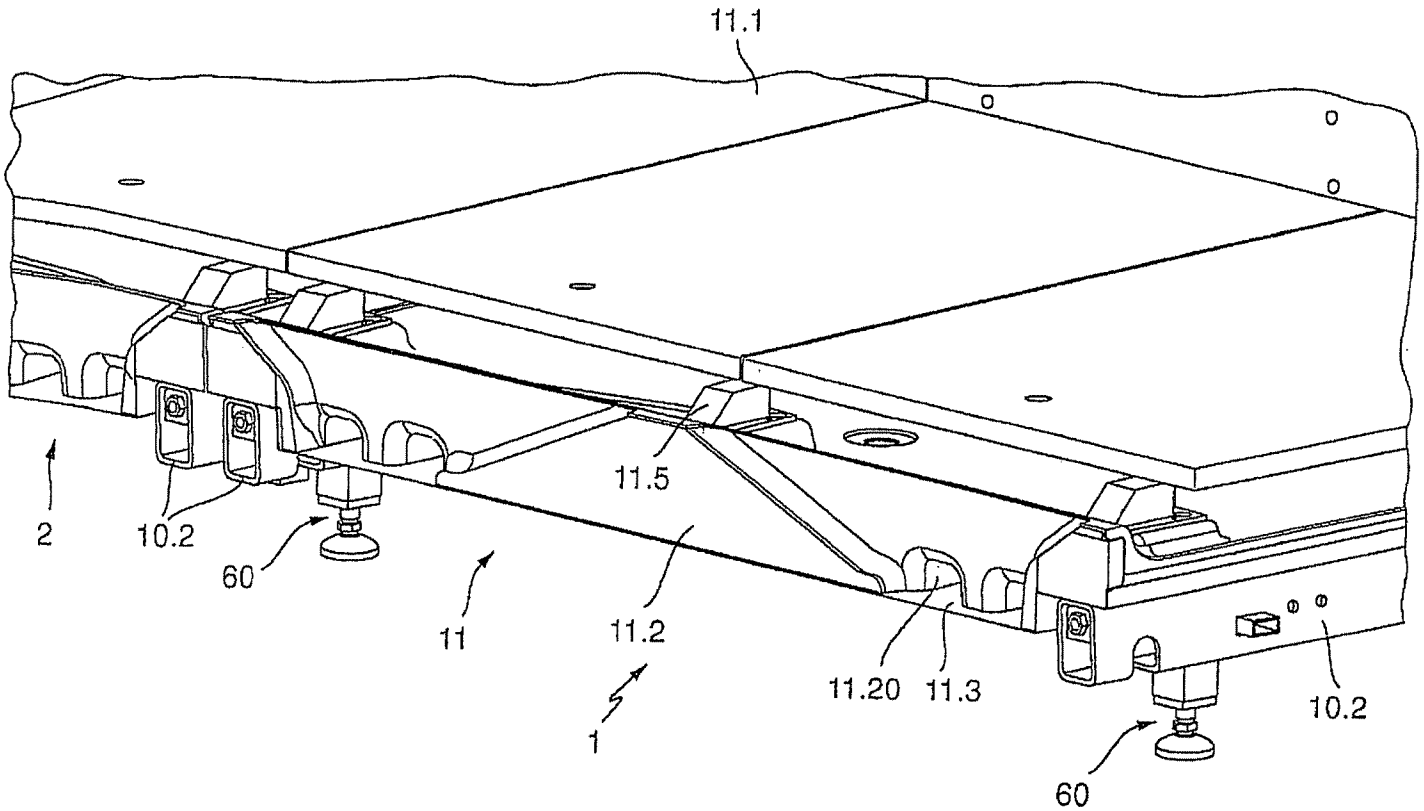
FIG. 6 shows a front, bottom corner region of a cooling unit system in a perspective view obliquely from the front, above, and to the side.
Figure 7:
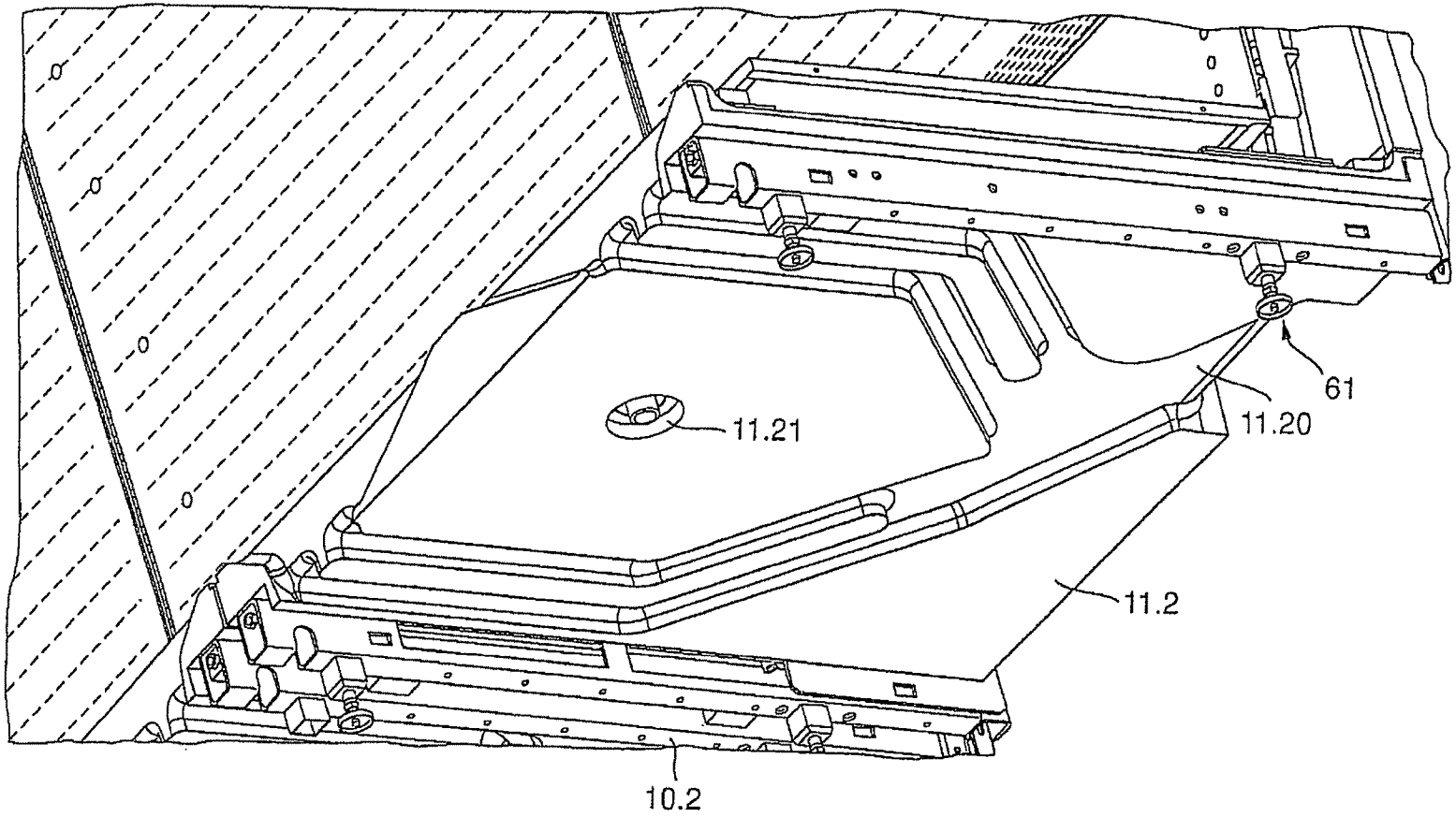
FIG. 7 shows a bottom corner region of a cooling unit system with the bottom base plate removed, in a perspective view obliquely from the front, below, and to the side.

As shown in greater detail from FIGS. 5, 6, and 7, the floor cover 11.1 is placed onto a plurality of block-shaped support elements 11.5 in the front region, such as plastic blocks composed of or comprising hard plastic, and are placed onto other support elements in the rear region, which are embodied, for example, in the form of support angles with forward-protruding support legs, particularly embodied in the form of an angled strip mounted to the lower section of the support profiles 10.4 of the two side frames 10.

Under the intermediate space 11.6 situated beneath the floor cover 11.1, there is a deflector plate 11.2 composed of or comprising heat-insulating and sound-insulating material, the top of which simultaneously serves as a catch basin for liquid that forms and has a drain hole 11.21, to which a drainpipe system is connected. On the underside, the deflector plate 11.2 is provided with a system 11.20 of molded conduits by which, beneath the deflector plate 11.2, a lower, outer horizontal intermediate space is embodied in the form of a lower, outer air flow conduit 11.7, which is covered at the bottom by a base plate 11.3 or a plurality of partial base plates or cover plates on the underside of the base group 11.

As shown in FIGS. 6 and 7, a plurality of conduits of the system 11.20 of molded conduits leading from respective inlet openings 11.70 are brought together at the rear of the deflector plate 11.2 on its underside and transition via a relatively wide recess or molded area of the deflector plate 11.2 into a rear, outer vertical intermediate space or outer vertical flow conduit 12.5 of the rear wall group 12 fluidically connected to them, which is embodied between the front side of the outer casing 12.3 and an intermediate partition with an intermediate wall 12.2 between the outer casing 12.3 and the inner cover 12.1, as is also shown by FIG. 3 and partially by FIG. 10. In order to produce the transition between the lower outer air flow conduit 11.7 and the lower section of the outer vertical flow conduit 12.5, the lower region of the relatively thick-walled insulating outer casing 12.3 can be cut out and, for example, only a thin cover plate can be left, which covers an insulation layer of the outer casing 12.3 on the hack side. The recess in the insulating outer casing 12.3 can, for example, be produced by subsequently cutting it out from the front, thin cover plate and the insulation layer or even during the manufacture by leaving this region free during the foaming and recessing of the front cover plate. In this way, the transition and a lower section of the vertical outer flow conduit 12.5 can be suitably positioned and can pass, for example, downstream of the lower fan 57 and to one side of a compressor accommodated in the lower region of the rear wall group 12 (see FIG. 1). Then, the vertical outer flow conduit 12.5 is spread out toward the top over the entire width of the rear wall group 12 by baffle elements.

Figure 8:
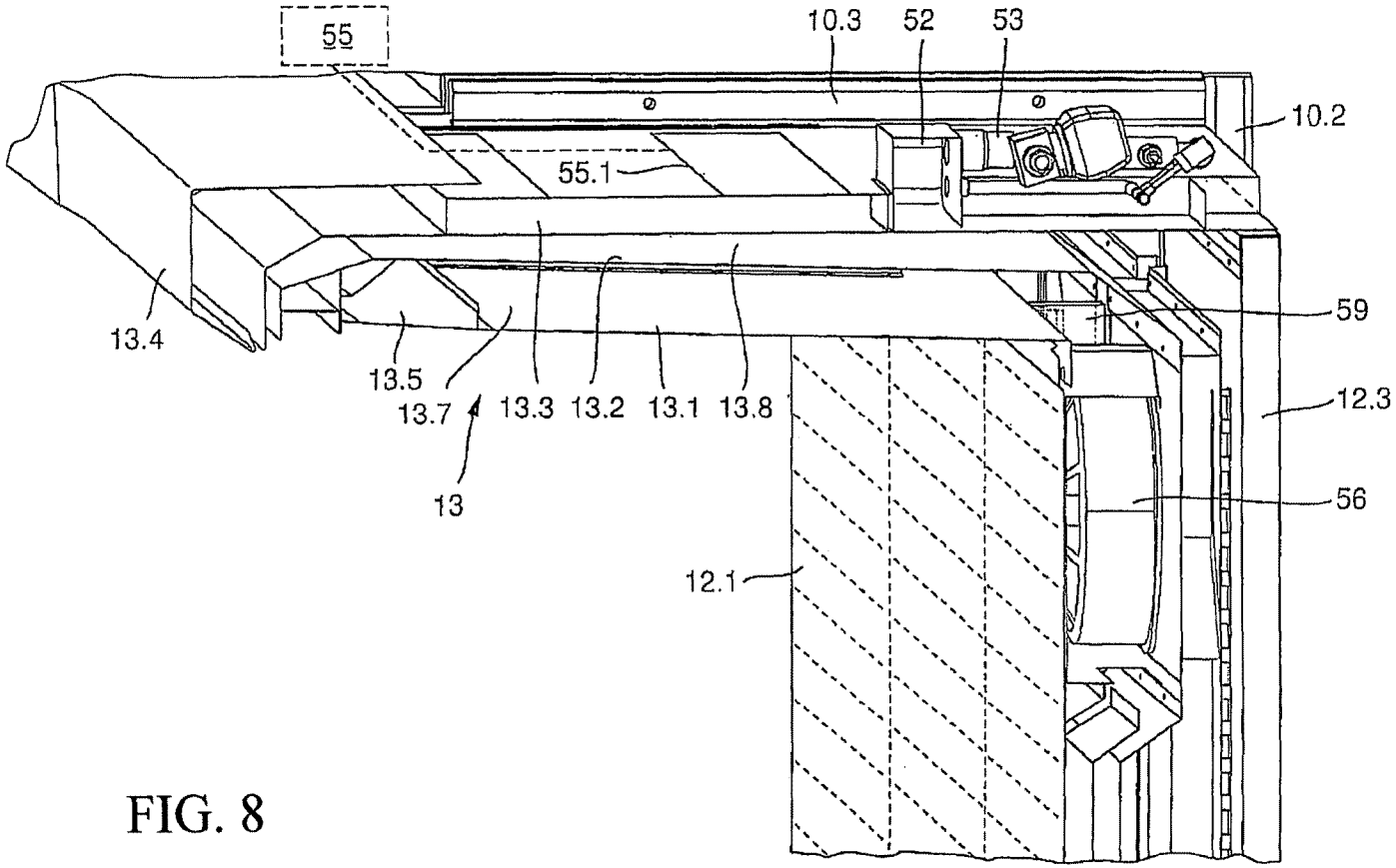
FIG. 8 shows an upper section of a shelving module, in a perspective view obliquely from the front, above, and to the side.
Figure 9A:
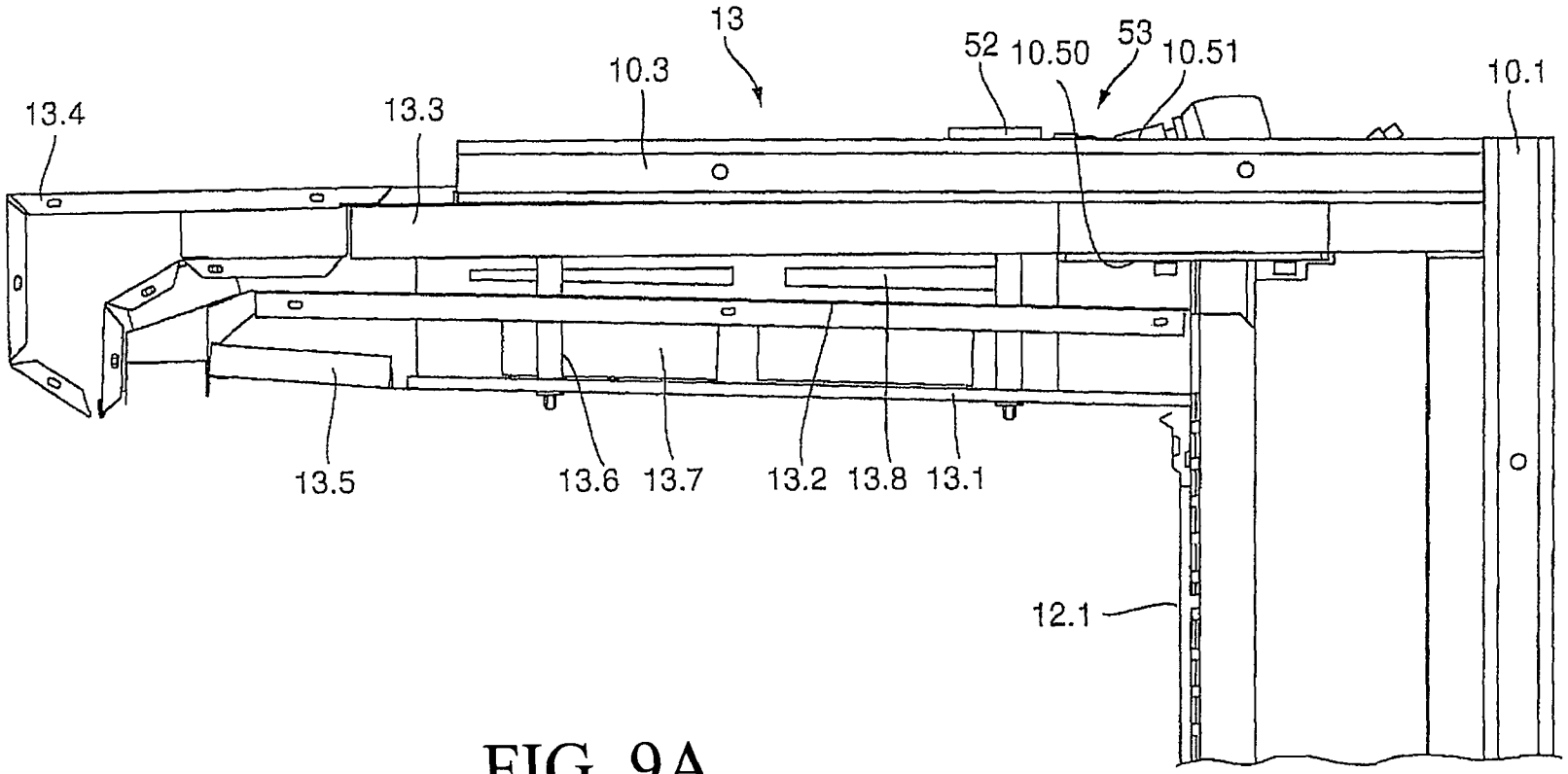
FIG. 9A shows an open side view of an upper section of a shelving module.

The fan 57 situated in the lower region of the rear wall group 12 is situated in the outer vertical intermediate space or in the vertical outer flow conduit 12.5 formed by it, which extends upward through the intermediate partition with the intermediate wall 12.2 behind the evaporator 50, 50', 50" and in front of the outer casing 12.3 and is connected to an outer upper intermediate space or outer upper flow conduit 13.8, forming a fluidic connection, as is clear from FIGS. 8 and 9A in connection with FIG. 10. In the upper group 13, the outer upper flow conduit 13.8 is divided from the inner upper flow conduit 13.7 by an intermediate cover 13.2 and extends between the intermediate cover 13.2 and the underside of the upper cover 13.3 to the front top section 13.4 and exits from the latter through an outlet slit 13.80 provided on the underside, spaced apart from the outlet opening 13.50 with the outlet grating 13.5, in order to form, on the front side of the relevant shelving module 1, 2, 3 or cooling unit system, a warm air curtain 71 situated in front of the cold air curtain 70. In the front region of the base group 11, the air flow produced by the warm air curtain 71 enters a slit-like inlet opening situated in front of the cover grating 11.10, into the lower outer intermediate space or lower outer flow conduit in order to form a warm air circuit.

As shown in FIGS. 9A and 10, the lower cover 13.1, the intermediate cover 13.2, and the upper cover 13.4 in the upper group 13 are held apart from one another by a plurality of jointly used support pins 13.6 in order to form the inner upper intermediate space 13.7 and the outer upper flow conduit 13.8. The upper cover 13.3 in this case is embodied in a thermally insulated way in the form of an insulating plate composed of or comprising insulation, for example in a way that corresponds to that of the outer casing 12.3. The insulating cover 13.3, together with the insulating outer casing 12.3 of the rear wall group 12 and the insulating deflector plate 11.2 of the base group 11, forms a shell-like thermal insulation.

In the exemplary embodiment shown, the insulating outer casing 12.3 of the rear wall group 12, the insulating upper cover 13.3 of the upper group 13, and the insulating deflector plate 11.2 of the base group 11 are each mounted to the inside of the vertical profile 10.1 oriented toward the cooling chamber 4, to the upper horizontal profiles 10.3, and to the lower horizontal profiles 10.2, respectively, of the associated side frames 10. At least on the inside oriented toward the cooling chamber numeral 4, the outer casing 12.3 is provided with a stable covering or is entirely embodied in the form of a stable, load-bearing plate so as to permit the intermediate wall 12.2 of the intermediate partition to be mounted thereon in a stable fashion, for example by a vertical spacer profiles that have an H-shaped cross-section, with the relevant spacing for the outer vertical intermediate space. The intermediate wall 12.2 can be bent at the vertical edges, such as in a Z shape, with end sections protruding outward in a flange-like fashion, and can be fastened to the side of the outer casing 12.3 oriented toward the cooling chamber 4, such as by screws or rivets.

The intermediate wall 12.2, which is composed of or comprises sheet steel or another suitable metal, offers a stable support base for the attachment of the evaporator 50, 50', 50", which advantageously extends across a plurality of shelving modules 1, 2, 3, as described above. The evaporator 50, 50', 50", which can be composed of or comprises sections associated with the shelving modules 1, 2, 3, is thus situated in the region of the cooling air conduit in front of the warm air conduit and is mounted there in stable fashion by connectors of the receiving device, such as by fastening screws and fastening lugs. In an evaporator 50, 50' 50" extending across a plurality of shelving modules 1, 2, 3, there is enough space provided at least on one side, (for example, see FIG. 1) so that connectors can be placed in this region for connecting lines for the refrigerant supply and for the injection of the refrigerant, such as a plurality of injection valves of the injection system, for the evaporation. The evaporator 50, 50', 50" in this case is not fastened to the frame profiles or support profiles so that on the one hand, no thermal transmission to the outside via the frame occurs and on the other hand, the support profiles 10.4 can be installed and removed without hindrance.

In alternative exemplary embodiments, in lieu of an evaporator for the cooling, it is also possible for another heat exchanger to be built into the rear wall group 12 or the upper region of the cooling unit, with the refrigerant advantageously being cooled in a remotely positioned central heat exchanger (such as with a water chiller).

Figure 9B:
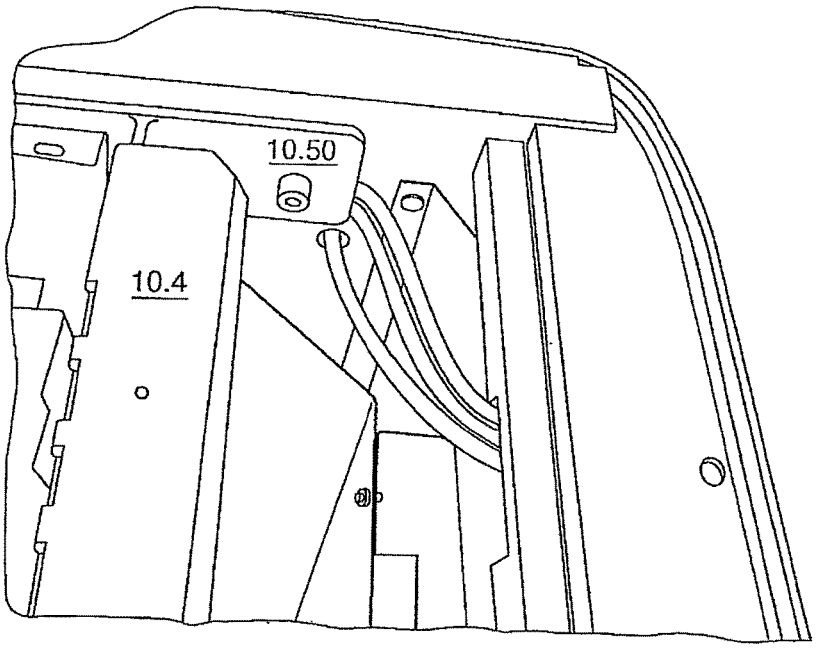
FIGS. 9B and 9C show an upper and lower corner region, respectively, of a shelving module in a perspective view.
Figure 9C:
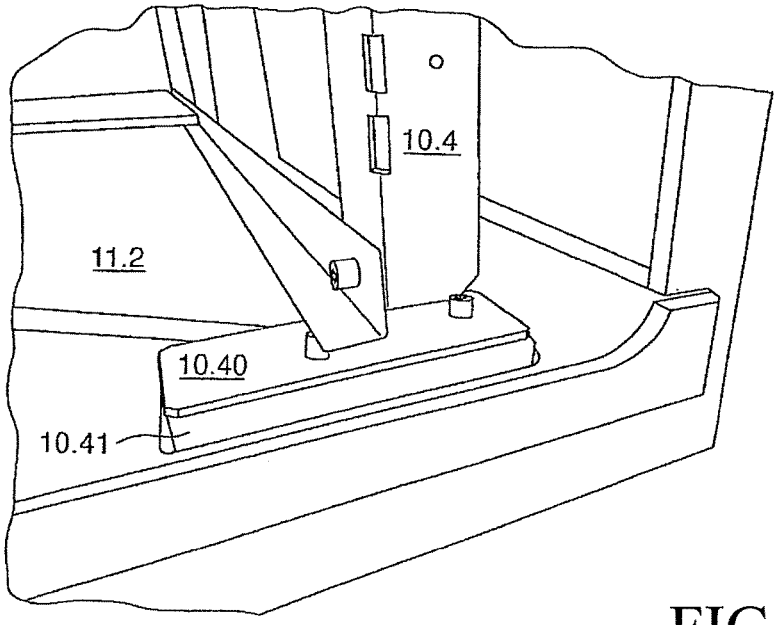

The support profile 10.4 is screwed to and supported on the underside of the upper horizontal profile 10.3 of the side frame 10 in stable fashion by an intermediate piece that is elongated from front to back and an upper support plate 10.50 (see FIG. 9B). As already shown in FIG. 5 and illustrated in FIGS. 9B and 9C, on its underside, the support profile 10.4 is supported by a support plate 10.40 that extends from front to back relative to the top of the lower horizontal profile 10.2 of the relevant side frame 10. Advantageously, an intermediate piece 10.41 made of hard plastic is inserted, which produces both a thermal insulation and a sound installation. This attachment permits the support profiles 10.4 to be easily installed and removed. In this case, the fastening elements for attaching the intermediate pieces to the horizontal profiles 10.2, 10.3 on the one hand and for attaching the support plate 10.40, 10.50 of the support profiles 10.4 to the intermediate pieces on the other hand are offset so that no continuous metallic thermally conductive contact is produced between the support profile 10.4 and the horizontal frame profiles 10.2 and 10.3.

The metallic support profiles 10.4 are provided with rows of holes in a predetermined, preferably standardized, spacing pattern, in which the plates of the inner cover 12.1 of the rear wall group 12 are accommodated so that they can be easily hooked and unhooked. In addition, support arms for the shelves can easily be hooked into the support profiles at the desired height.

Anti-tipping devices 62 protruding downward are mounted at the lower end section of the vertical profiles 10.1, which advantageously permit an adaptation to uneven floors, for example by resilient or elastic intermediate elements and/or adjusting elements. A lighting device 64 can be positioned in the front region of the base group 11 and/or upper group 13. Advantageously, a roller curtain 63 is situated in the front, upper region in order to close the cooling chamber at the front, for example during non-business hours, and thus to save cooling energy.

Sealing components are installed at the sides in order to seal the intermediate spaces in the base groups 11, rear wall groups 12, and upper groups 13 of the shelving modules 1, 2, 3.

In this case, the sealing components are advantageously inserted, for example, between the adjacent outer casings 12.3, the upper covers 13.3, and particularly also between the deflector plates 11.2. Additional sealing elements can in fact or solely be situated between the side frames 10 of adjacent shelving modules 1, 2, 3 aligned next to one another in order to seal the cooling chamber 4 between the shelving modules 1, 2, 3, but the side frames 10 are clamped to one another in a stable fashion and with a definite positioning, preferably only by interposed spacer elements such as spacer sleeves. Various embodiments of sealing elements can be used for the sealing components, for example sealing strips with a mushroom-shaped cross-section and leaves. In addition, with adapted sealing components, side walls can be attached to the side frames 10 in a corresponding fashion, such as particularly can be attached to the narrow edges of the outer casing 12.3, to the lower cover 13.3, and to the deflector plates 11.2 in a sealed fashion at the respective connecting edge.

Various lateral partitioning elements can be used for laterally sealing the inner intermediate spaces 11.6, 12.4, 13.7 for the cold air flow and the outer flow conduits 11.7, 12.5, 13.8 for the warm air flow. In an exemplary embodiment that has been tested in an experimental setup, with a plurality of shelving modules 1, 2, 3 in a row, the inner intermediate spaces 12.4 of the rear wall group 12 are continuously connected to one another across the entire cooling unit system and only terminated in a sealed fashion at the two ends of the cooling unit system by relevant partitioning elements. This has one advantage of not hindering the use of a continuous evaporator 50', 50". By contrast, in an advantageous embodiment, the inner intermediate spaces 11.6 and 13.7 of the base group 11 and upper group 13 are partitioned on both sides of each shelving module 1, 2, 3 and are connected to the vertical, inner intermediate space 12.4 by appropriate air baffle plates in order to avoid disadvantageous flow leakages. The inner cover 12.1 of the rear wall group 12 is supplemented by intermediate plates in the transition region between the aligned shelving modules 1, 2, 3.

In the tested exemplary embodiment, the outer flow conduits 11.7, 12.5, 13.8 are respectively partitioned for each shelving module 1, 2, 3. In the rear wall group 12, this occurs in the region of or near the intermediate wall 12.2, for example by its lateral edges or by inserted strips, and correspondingly also in the region of the upper group 13 and in the region of the base group 11, for example by the molded indentations on the underside of the deflector plate 11.2.

Figure 11A:
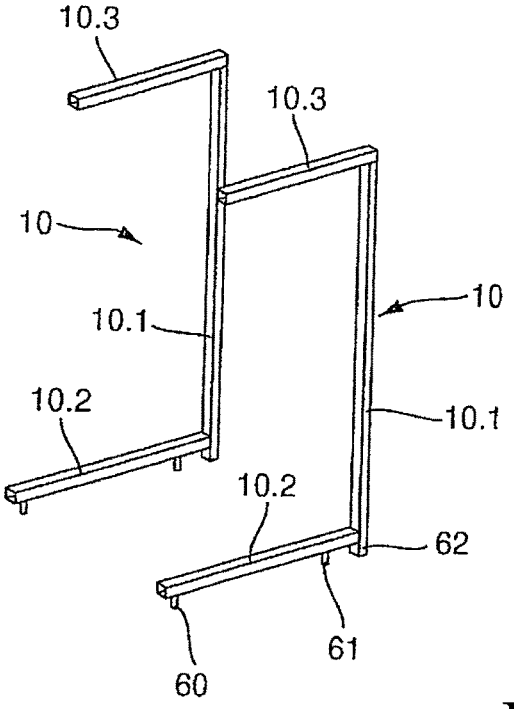
FIGS. 11A through 11X show different depictions of assembly steps of a shelving module according to different embodiments of this invention.
Figure 11B:
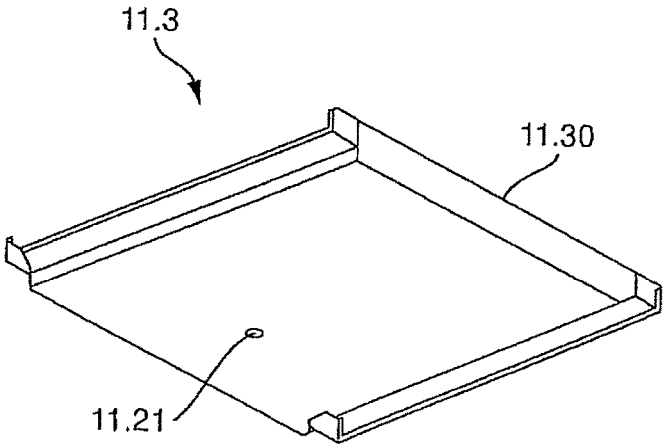
Figure 11C:
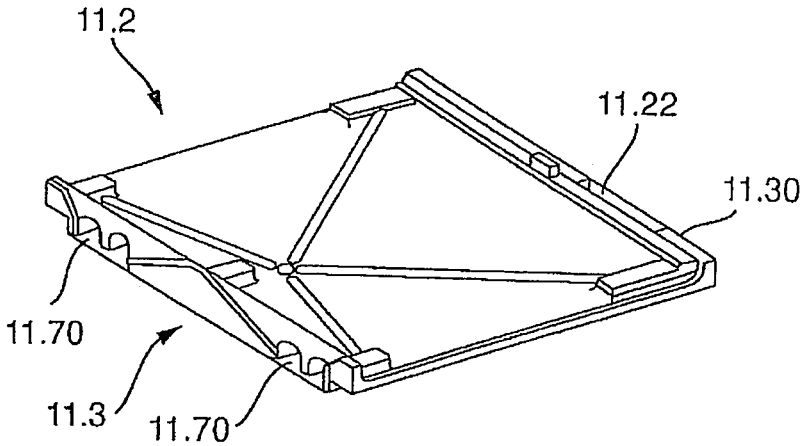
Figure 11D:
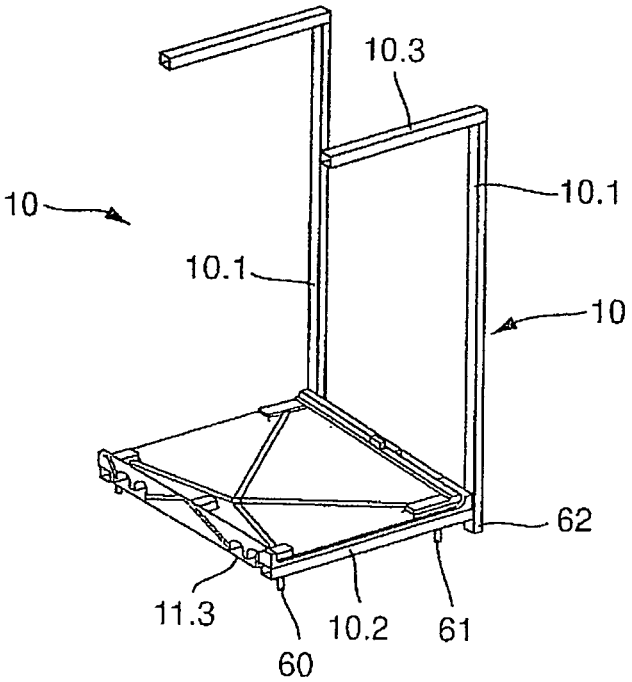
Figure 11E:
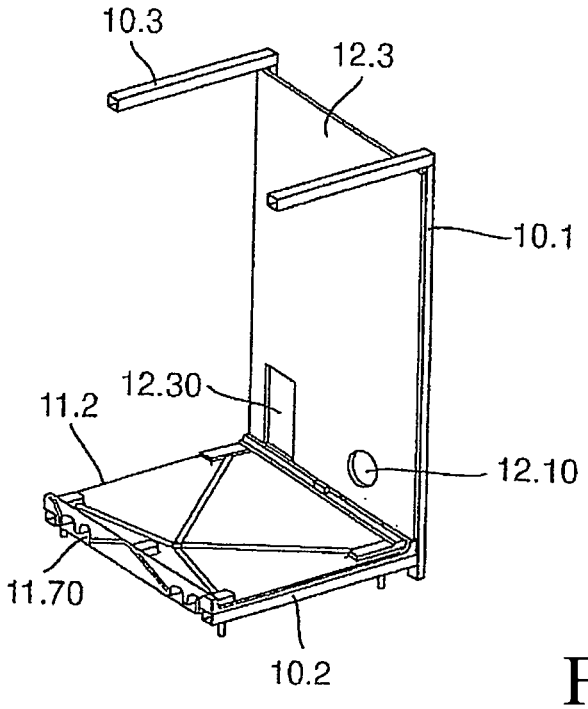
Figure 11F:
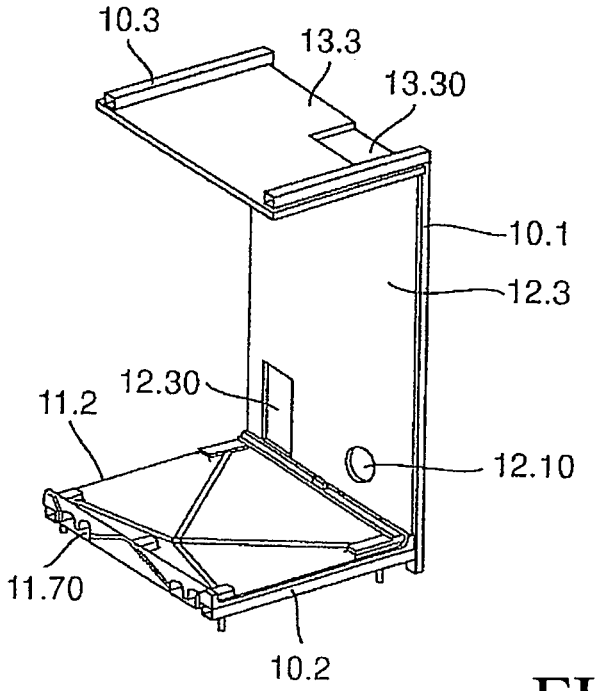
Figure 11G:
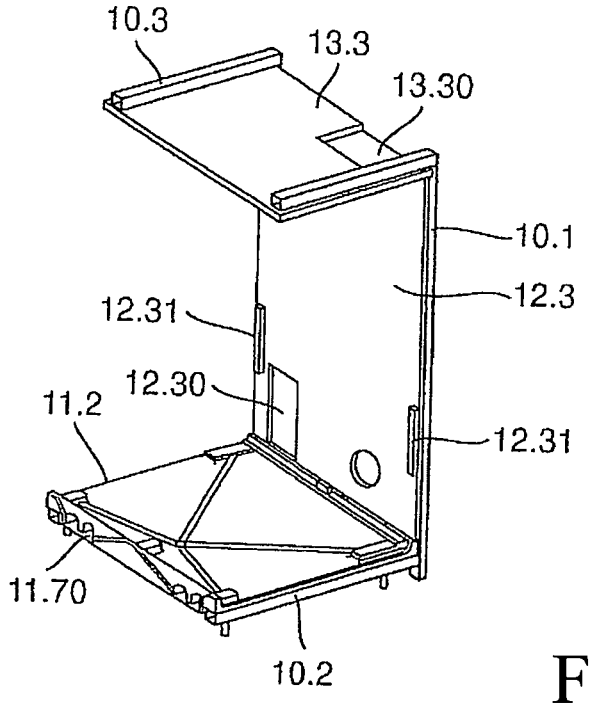
Figure 11H:
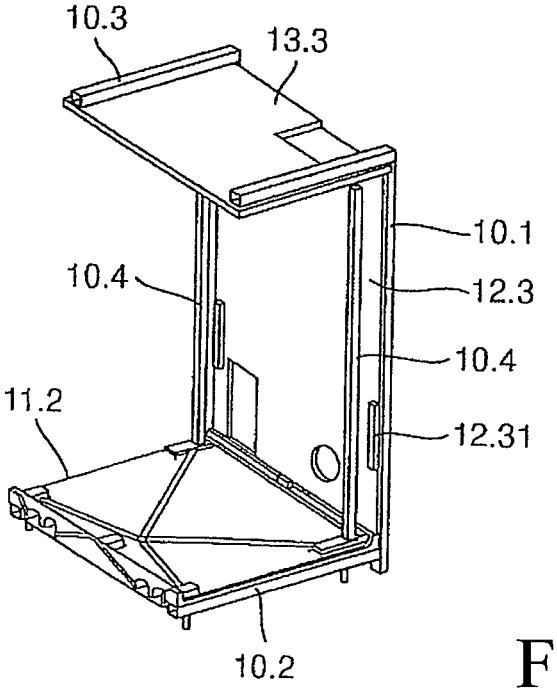
Figure 11I:
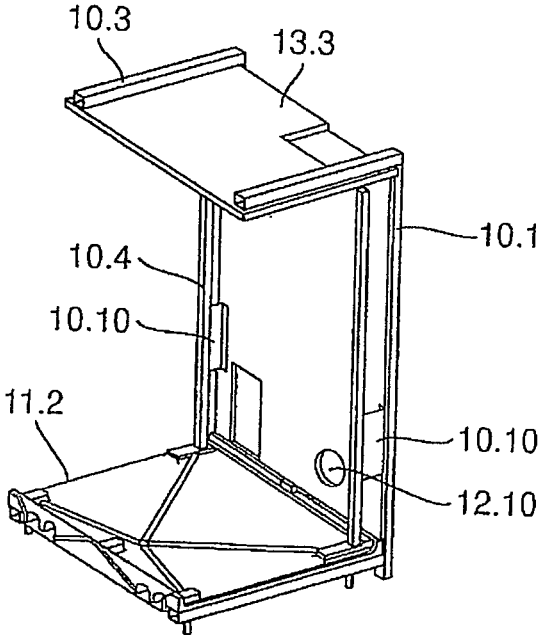
Figure 11J:
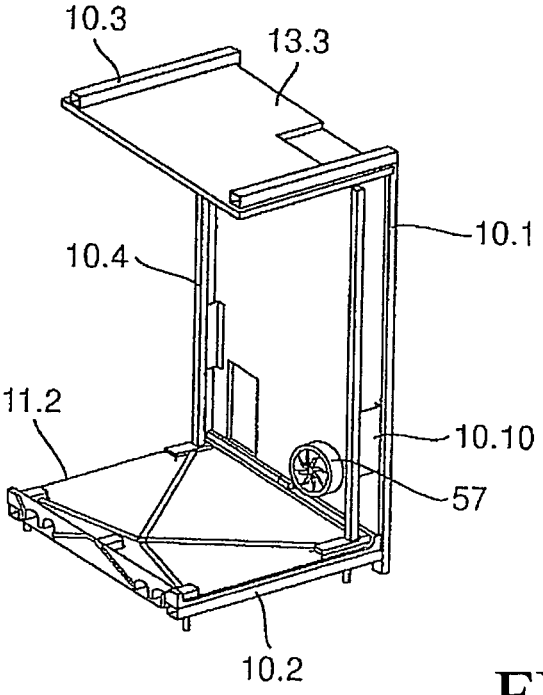
Figure 11K:
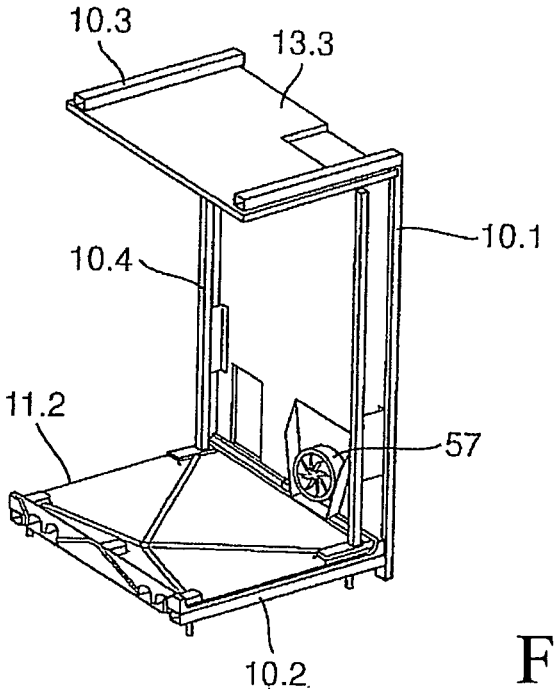
Figure 11L:
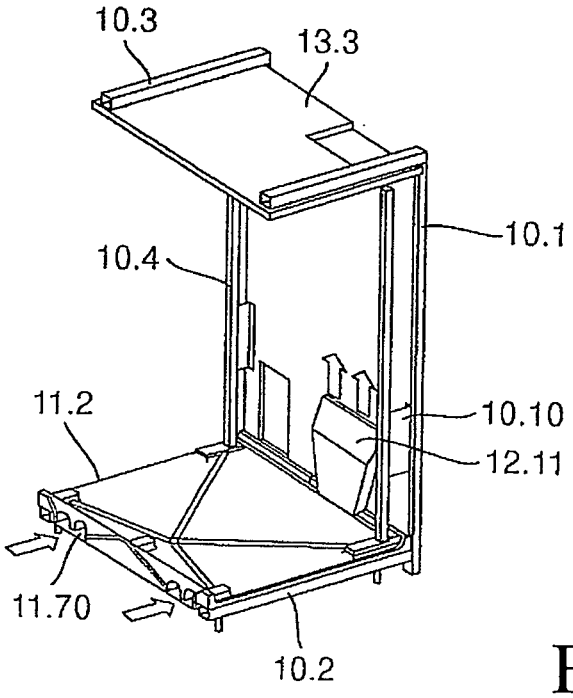
Figure 11M:
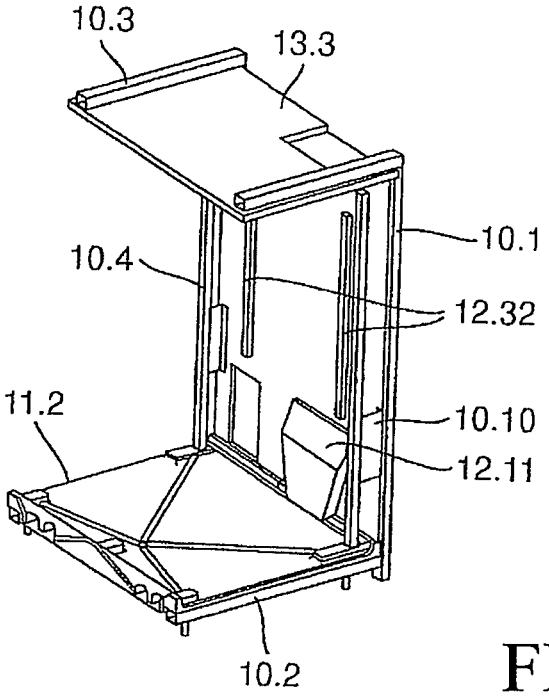
Figure 11N:
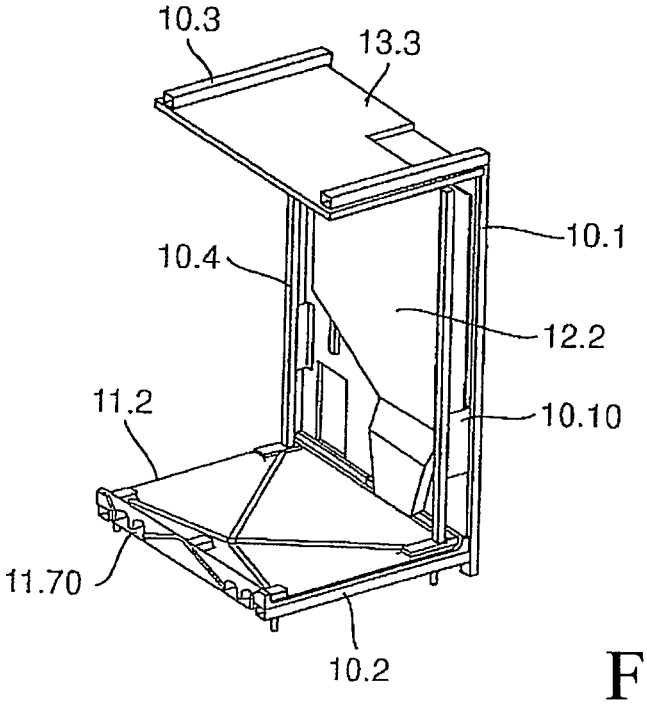
Figure 11O:
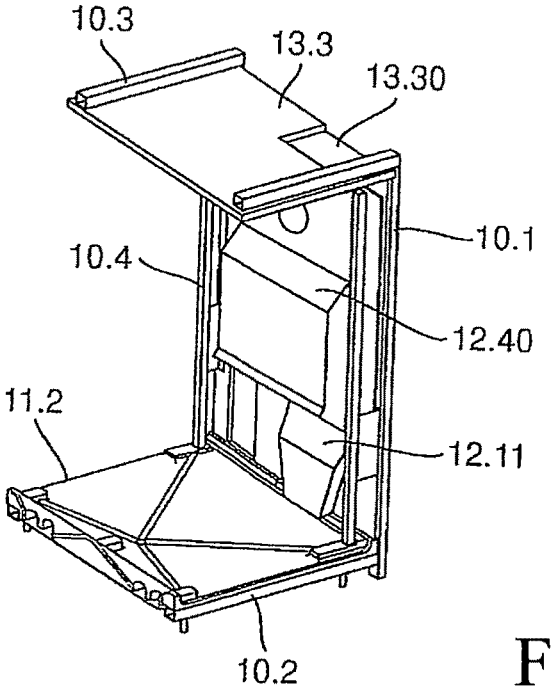
Figure 11P:
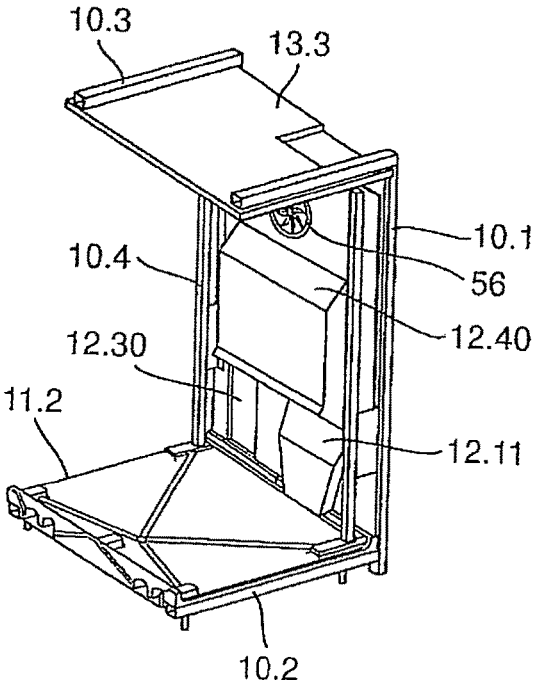
Figure 11Q:
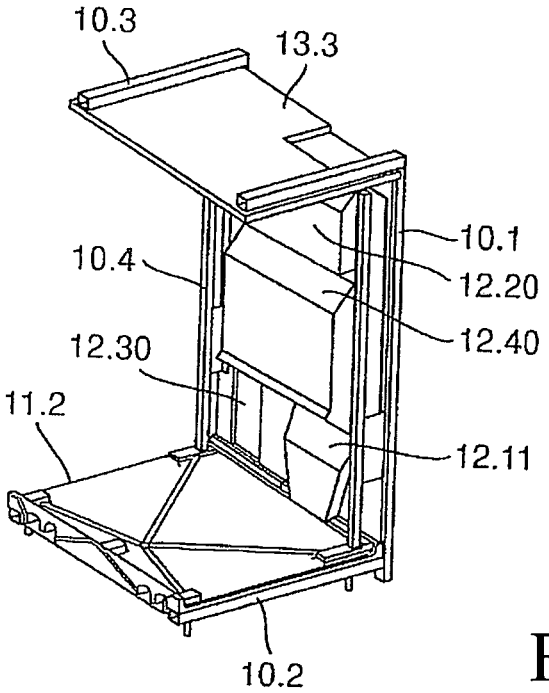
Figure 11R:
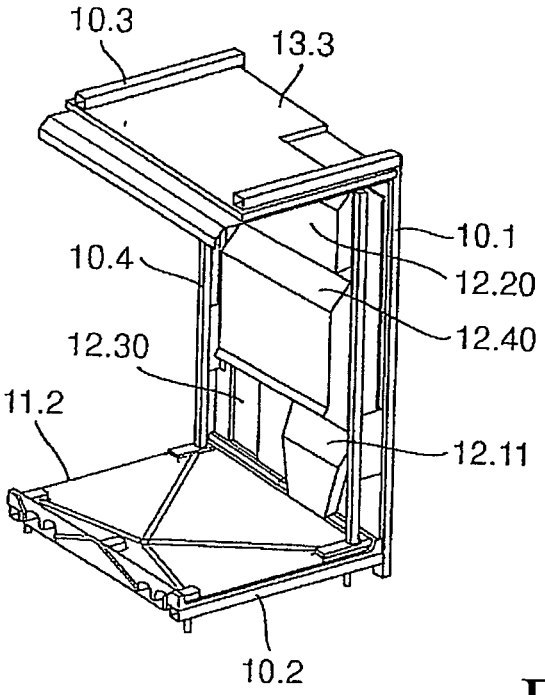
Figure 11S:
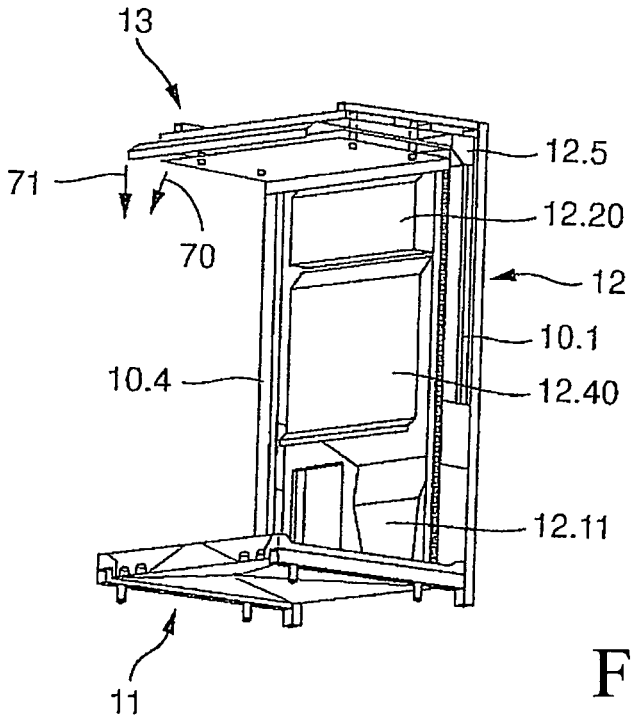
Figure 11T:
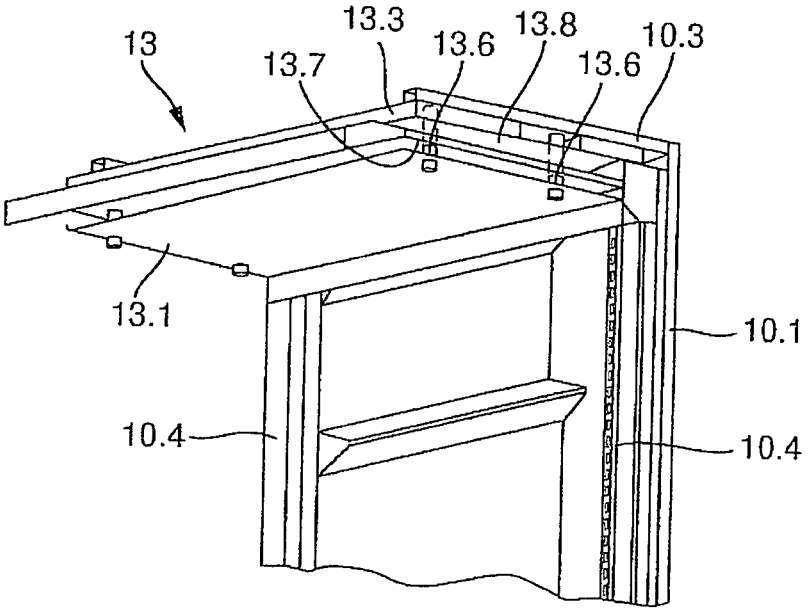
Figure 11U:
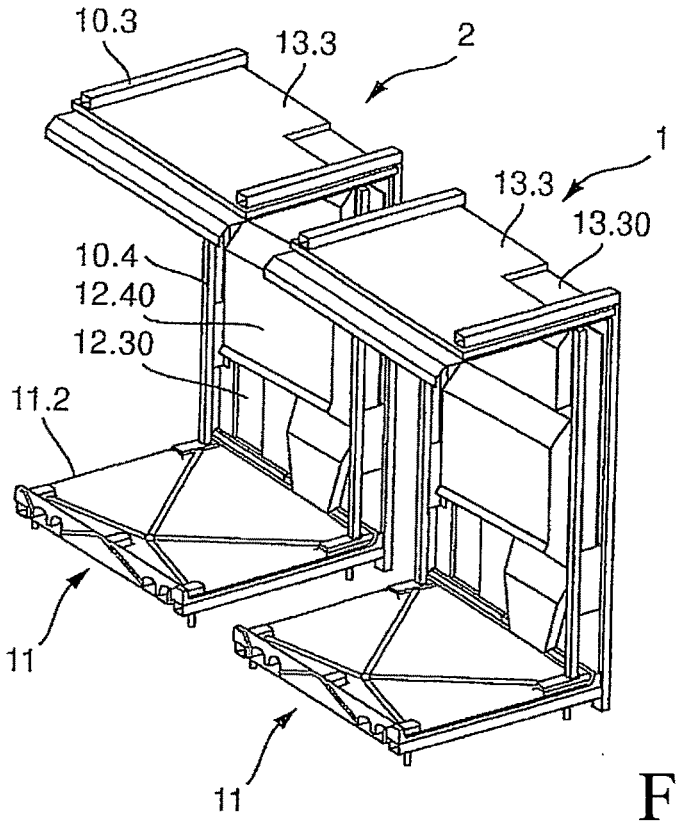
Figure 11V:
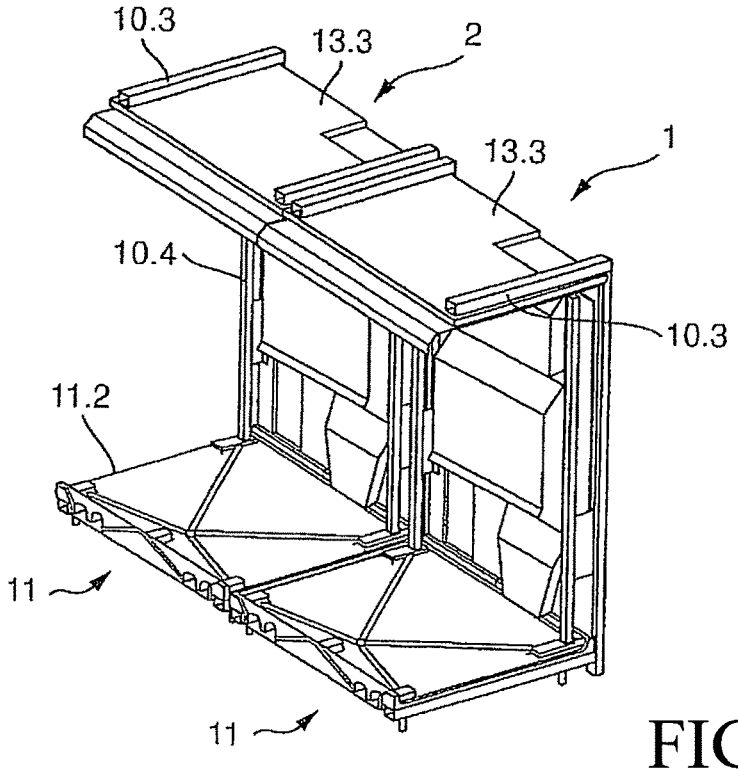
Figure 11W:
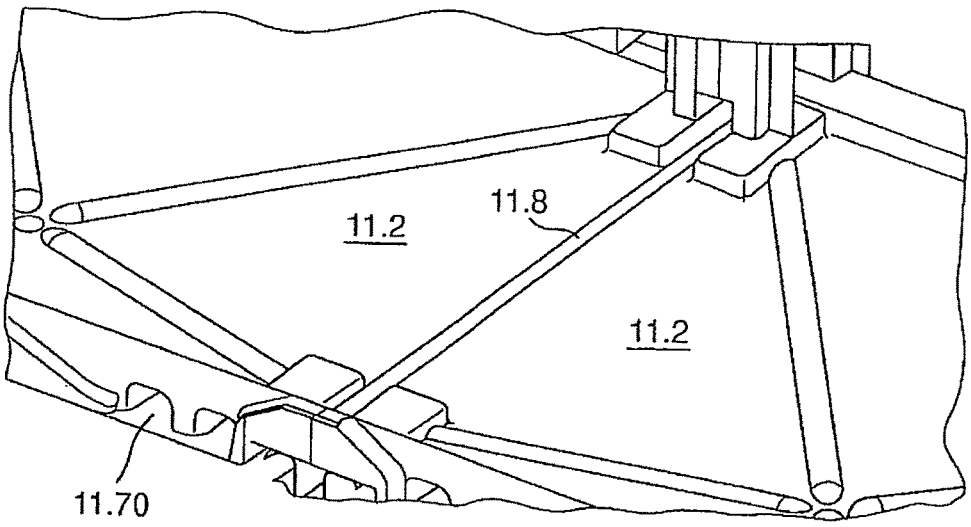
Figure 11X:
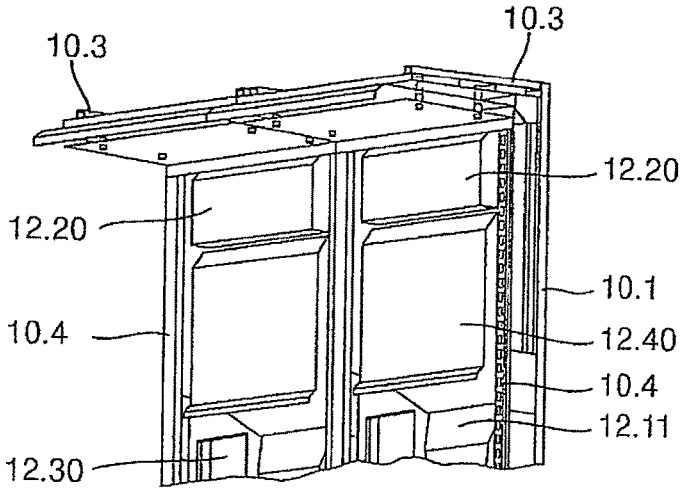

FIGS. 11A through 11X show one exemplary embodiment for successive assembly steps of constructing a shelving module 1, 2, 3 or cooling unit as well as a system composed of or comprising two shelving modules. If so desired, individual assembly steps here can also be omitted, changed, or swapped.

First, according to FIG. 11A, two side frames 10 are each produced from a vertical profile 10.1, a lower horizontal profile 10.2 protruding forward in the vertical profile's lower region, and an upper horizontal profile 10.3 protruding forward in the vertical profile's upper region. The undersides of the lower horizontal profiles 10.2 are provided with height-adjustable feet 60, 61 and at the lower end of the vertical profiles 10.1, the anti-tipping device 62 protrudes downward. In the exemplary embodiment shown, the upper horizontal profile 10.3 is embodied as shorter than the lower horizontal profile 10.2, but in a likewise advantageous embodiment, the upper horizontal profile 10.3 can be embodied as exactly the same length or longer than the lower horizontal profile 10.2, in order to be able to attach the upper group 13 in a stable fashion. The two side frames 10 are embodied as spaced apart from each other in accordance with the width of the shelving module 1, 2, 3.

In another step (FIG. 11B), the base plate 11.3 as the lower cover of the base group 11 is provided with a back side 11.30 that is to be turned toward the vertical profiles 10.1 and the drain hole 11.21. This covers the underside of the deflector plate 11.2 with the molded conduits 11.20, as shown in the subsequent assembly step according to FIG. 11C. In lieu of the base plate 11.3, however, the molded conduits 11.20 can also be separately covered and advantageously sealed by one or more partial plates. As also shown in FIG. 11C, the molded conduit 11.20 that is composed of or comprises, for example, a plurality of sub-conduits feeds into a relatively wide slit-like outlet opening 11.22 situated on one side of the back of the deflector plate 11.2, opens upward and is delimited on the back side by a bending of the base plate 11.3 or a partial plate. The drawing also shows the inlet openings 11.70 of the molded conduit 11.20.

In a subsequent step according to FIG. 11D, the thus-prepared deflector plate 11.2 is placed onto the lower horizontal profiles 10.2 and fastened.

Then according to FIG. 11E, the thermally insulating outer casing 12.3 is mounted onto the front side of the vertical profiles 10.1. In the lower region, the outer casing 12.3 is provided with a compressor opening 12.30 extending through it for subsequent installation of the compressor, which is situated next to the outlet opening 11.22 of the deflector plate 11.2. Above the outlet opening 11.22, a lower fan opening 12.10 is provided in the outer casing 12.3, but is covered on the back side of the outer casing 12.3 such as with a thin covering layer of the outer casing 12.3 or a separate plate and forms a conduit for the air flow from the outlet opening 11.22 of the lower fan 57 to be subsequently installed.

In another step, the upper cover 13.3 is mounted to the underside of the upper horizontal profiles 10.3 (FIG. 11F). In the exemplary embodiment shown, the upper cooling component receptacle 13.30 is cut out from the right, rear of the top side of the upper cover 13.3, leaving only a lower covering layer of the thermally insulating upper cover 13.3.

In the next step shown in FIG. 11G, spacers 12.31 are fastened to the front side of the outer casing 12.3 in the vicinity of or near the vertical edges.

Then, the support profiles 10.4 are installed between the upper and lower horizontal profiles 10.3, 10.2, in their rear region, spaced apart from and parallel to the front side of the vertical profiles 10.1, using the support plates 10.40, 10.50 and the insulating intermediate pieces between the underside of the upper cover 13.3 and the top side the deflector plate 11.2 (FIG. 11H).

In the next step of the method (FIG. 11I), fixing parts 10.10 are mounted, if necessary, between the support profiles 10.4 and the vertical profiles 10.1, for stiffening purposes or to serve as holding elements, but can also be omitted if the supporting force is sufficient.

In a subsequent step (FIG. 11J), the lower fan 57 is mounted in front of the lower fan opening 12.10 and in subsequent steps, is enclosed with a fan housing 12.11 (FIGS. 11K and 11L) in order to form the lower region of the outer vertical flow conduit.

In another step (FIG. 11M), the front side of the outer casing 12.3 has strip-like vertical spacers 12.32 mounted onto it, onto which the intermediate wall 12.2 is mounted, spaced apart from the outer casing 12.3 to form the upper region of the vertical flow conduit, producing a connection to the upper opening of the fan housing 12.11 (FIG. 11N).

A plate-like cooling air baffle plate 12.40 is mounted onto the intermediate wall 12.2 and spaced apart from it, behind which the evaporator 50, 50', 50" (not shown) or another heat exchanger is placed. In addition, the upper fan 56 is mounted on a plate that is spaced apart from the intermediate wall 12.2 (FIGS. 11O and 11P). The upper fan 56 or instead of it, a plurality, such as two, upper fans situated next to one another, in which case it is also possible to omit the lower fan 57, each is covered by an upper fan cover 12.20 in a housing-like fashion. Cooling air flowing upward out of the evaporator 50, 50', 50" or heat exchanger is taken in by the upper fan 56, for example in the axial direction, and conveyed away in the radial direction, in fact with one partial flow traveling downward on the inside of the cooling air baffle plate 12.40 oriented toward the cooling chamber and one partial flow traveling upward into the upper, inner intermediate space 13.7 of the correspondingly added upper group 13 (FIGS. 11Q and 11R). The housing-like upper fan cover 12.20 is embodied to route the air flow in the desired direction and with the desired intensity and can also be provided with an intermediate partition between two fans 57 in order to avoid a reciprocal influence (such as short-circuiting). For example, outflow openings of a calibrated size can be provided in the fan cover 12.20, toward the top and bottom and also toward the front if so desired.

The outer vertical flow conduit 12.5 is also connected to the relevant outer upper flow conduit 13.8 of the upper group 13, after which the outer upper flow conduit 13.8 and the upper intermediate space 13.7 in the upper group 13 are produced using the support pins 13.6 (FIGS. 11S and 11T). In this case, the slit-like outlet opening 13.50 and the outlet slit 13.80 for the cold air curtain 70 and the warm air curtain 71 are also provided in the front, lower region of the upper group 13.

In other steps, a cooling unit system is constructed, such as out of two shelving modules 1, 2, as shown in FIGS. 11U, 11V, 11W, and 11X. In these steps, the side frames 10 on the vertical profiles 10.1, the lower horizontal profiles 10.2, and/or the upper horizontal profiles 10.3 are clamped to each other in a definite relative position with the interposition of spacer elements such as spacer sleeves and are sealed along the narrow edges that face one another on their outer casings 12.3, deflector plates 11.2, and upper covers 13.3 with the interposition of sealing elements such as sealing strips 11.8 with a mushroom-shaped cross-section.

The invention claimed is:

1. A cooling unit, comprising:

a base group (11), a rear wall group (12), and an upper group (13), which delimit a cooling chamber (4) from below, back, and above and are provided at least in part with components of a cooling device (5) and which have a multilayered structure with a flow conduit system embodied therein;

an inner flow conduit including intermediate spaces formed between respective layers in each of the base group (11), the rear wall group (12), and the upper group (13), to allow air to circulate;

the inner flow conduit including a vertical intermediate space (12.4) formed in the rear wall group (12), a lower intermediate space (11.6) formed in the base group (11) and having a rear side fluidically connected to a lower section of the vertical intermediate space (12.4), and an upper intermediate space (13.7) formed in the upper group (13) and having a rear side fluidically connected to an upper section of the vertical intermediate space (12.4);

an evaporator (50, 50', 50") or other heat exchanger of the cooling device (5) is situated in the vertical intermediate space (12.4) for generating cooling air;

a plurality of fans (56) of the cooling unit provided above the evaporator or other heat exchanger in the vertical intermediate space (12.4) to produce an air flow through the intermediate spaces (11.6, 12.4, 13.7), wherein an intermediate fan partition is installed between each adjacent pair of the fans (56) in the vertical intermediate space (12.4) in order to avoid or reduce a reciprocal negative flow influence or short-circuiting;

an outer flow conduit for stratified air flow routing separated from the inner flow conduit and extending along a side of the inner flow conduit that is oriented away from the cooling chamber (4), the outer flow conduit including an outer vertical flow conduit (12.5) formed in the rear wall group (12) between an outer casing (12.3) of the rear wall group (12) and an intermediate partition (12.2) that delimits the vertical intermediate space (12.4) at the back, an outer lower flow conduit (11.7) formed in the base group (11) between a base plate (11.3) of the base group (11) and a deflector plate (11.2) that delimits the lower intermediate space (11.6) at the bottom, and an outer upper flow conduit (13.8) formed in the upper group (13) between an upper cover (13.3) of the upper group (13) and an intermediate cover (13.2) that delimits the upper intermediate space (13.7) at the top, and wherein the intermediate partition (12.2) connects to and between each of the deflector plate (11.2) and the intermediate cover (13.2) to fluidically connect the outer lower flow conduit (11.7) to a lower section of the vertical outer flow conduit and fluidically connect the outer upper flow conduit (13.8) to an upper section of the vertical outer flow conduit in order to allow the air to circulate.

2. The cooling unit of claim 1, wherein each of the plurality of fans comprises a radial fan.

3. The cooling unit according to claim 2, wherein the fans (56) embodied as radial fans, are situated in an upper half of the vertical intermediate space (12.4) above the evaporator (50, 50', 50") or other heat exchanger.

4. The cooling unit according to claim 3, wherein at least some sections of the vertical intermediate space (12.4) are situated directly against a back side of a plate-shaped inner cover (12.1) of the rear wall group (12) adjoining the cooling chamber (4), at least some sections of the lower intermediate space (11.6) are situated directly against a back side of a plate shaped floor cover (11.1) of the base group (11) adjoining the cooling chamber (4), and at least some sections of the upper intermediate space (13.7) are situated directly against a top surface of a lower cover (13.1) of the upper group (13) adjoining the cooling chamber (4).

5. The cooling unit according to claim 4, wherein the upper intermediate space (13.7), via a slit-like outlet opening (13.50) in a front top section (13.4), is brought into a fluidic connection with the lower intermediate space (11.6) via a slit-like inlet opening (11.11) in the front section of the base group (11) in order, together with the upper intermediate space (13.7), the lower intermediate space (11.6), and the vertical intermediate space (12.4), to produce a circulating air flow by a front air curtain.

6. The cooling unit according to claim 5, wherein in front of the evaporator (50, 50', 50") or other heat exchanger, there is an open space for conveying away cooling air produced in the evaporator (50, 50', 50") or other heat exchanger, which cooling air travels into the cooling chamber (4) through distributed openings in the inner cover (12.1).

7. The cooling unit according to claim 6, wherein the outer upper flow conduit (13.8), via an outlet slit (13.80) situated in the front top section, in front of the slit-like outlet opening (13.50), is brought into a fluidic connection with the outer lower flow conduit (11.7) via an inlet opening (11.70) in the front section of the base group (11) in order, together with the outer upper flow conduit (13.8), the outer lower flow conduit (11.7), and the outer vertical flow conduit (12.5), to produce a circulating air flow by an outer front air curtain which forms a warm air curtain (71) relative to the then inner front air curtain forming a cold air curtain (70).

8. The cooling unit according to claim 7, wherein in order to produce an air flow, the at least one fan (57) in the lower region of the vertical outer flow conduit (12.5) below the evaporator (50, 50', 50") or other heat exchanger.

9. The cooling unit according to claim 8, wherein the intermediate partition of the rear wall group (12) has an intermediate wall (12.2) mounted to the front side of the outer casing (12.3) and spaced apart from it by vertical spacer strips and/or Z-shaped bends at its vertical edges.

10. The cooling unit according to claim 9, wherein the outer casing (12.3) of the rear wall group (12), the deflector plate (11.2) of the base group (11), and the upper cover (13.3) of the upper group (13) are embodied in a form of thermally insulating plates.

11. The cooling unit according to claim 10, wherein the outer lower flow conduit (11.7) is at least partially composed of at least one conduit that is molded into the deflector plate (11.2).

12. The cooling unit according to claim 11, wherein the rear wall group (12), the upper group (13), and the base group (11) have plate-shaped wall elements, which are mounted to frame profiles of two side frames (10) that laterally delimit a shelving module (1, 2, 3).

13. The cooling unit according to claim 12, wherein the two side frames (10) have a C-shaped form when viewed from the side; in an upper and lower end region of each respective rear vertical profile (10.1), a lower horizontal profile (10.2) and an upper horizontal profile (10.3) are attached to protrude toward the front, and the plate-shaped wall elements of the rear wall group (12) are installed on the front side of the vertical profiles (10.1) on both sides, the plate-shaped wall elements of the upper group (13) are installed on the underside of the upper horizontal profiles (10.3), and the plate-shaped wall elements of the base group are installed between and/or on the lower horizontal frame profiles (10.2).

14. The cooling unit according to claim 13, wherein the evaporator (50, 50', 50") or other heat exchanger is fastened to the intermediate wall (12.2).

15. The cooling unit according to claim 14, wherein spaced apart from and in front of the vertical frame profiles (10.1), vertical support profiles (10.4) are installed between the lower and upper horizontal frame profiles (10.2, 10.3) by a thermally insulating connection.

16. The cooling unit according to claim 15, wherein a cooling unit system of a plurality of the cooling units aligned next to one another and embodied in the form of shelving modules (1, 2, 3), wherein transitions between the shelving modules (1, 2, 3) along the adjacent narrow edges of at least the plate-shaped wall elements of the rear wall group (12) are sealed by inserting sealing components; and the shelving modules (1, 2, 3) are screwed to one another in adjacent frame profiles.

17. The cooling unit according to claim 1, wherein at least some sections of the vertical intermediate space (12.4) are situated directly against the back side of a plate-shaped inner cover (12.1) of the rear wall group (12) adjoining the cooling chamber (4), at least some sections of the lower intermediate space (11.6) are situated directly against the back side of a plate shaped floor cover (11.1) of the base group (11) adjoining the cooling chamber (4), and at least some sections of the upper intermediate space (13.7) are situated directly against a top surface of a lower cover (13.1) of the upper group (13) adjoining the cooling chamber (4).

18. The cooling unit according to claim 1, wherein the upper intermediate space (13.7), via a slit-like outlet opening (13.50) in a front top section (13.4), is brought into a fluidic connection with the lower intermediate space (11.6) via a slit-like inlet opening (11.11) in the front section of the base group (11) in order, together with the upper intermediate space (13.7), the lower intermediate space (11.6), and the vertical intermediate space (12.4), to produce a circulating air flow by a front air curtain.

19. The cooling unit according to claim 1, wherein in front of the evaporator (50, 50', 50") or other heat exchanger, there is an open space for conveying away cooling air produced in the evaporator (50, 50', 50") or other heat exchanger, which cooling air travels into the cooling chamber (4) through distributed openings in an inner cover (12.1).

20. The cooling unit according to claim 1, wherein the intermediate partition of the rear wall group (12) has an intermediate wall (12.2) mounted to the front side of the outer casing (12.3) and spaced apart from it by vertical spacer strips and/or Z-shaped bends at its vertical edges.

21. The cooling unit according to claim 1, wherein the outer casing (12.3) of the rear wall group (12), the deflector plate (11.2) of the base group (11), and the upper cover (13.3) of the upper group (13) are embodied in a form of thermally insulating plates.

22. The cooling unit according to claim 1, wherein the outer lower flow conduit (11.7) is at least partially composed of at least one conduit that is molded into the deflector plate (11.2).

23. The cooling unit according to claim 1, wherein the rear wall group (12), the upper group (13), and the base group (11) have plate-shaped wall elements, which are mounted to frame profiles of two side frames (10) that laterally delimit a shelving module (1, 2, 3).

24. The cooling unit according to claim 23, wherein each of the two side frames (10) has a C-shaped form when viewed from the side; in an upper and lower end region of each respective rear vertical profile (10.1) the each of the two side frames (10) include a lower horizontal profile (10.2) and an upper horizontal profile (10.3) attached to protrude toward the front, and the plate-shaped wall elements of the rear wall group (12) are installed on the front side of the each respective rear vertical profile (10.1) on both sides, the plate-shaped wall elements of the upper group (13) are installed on the underside of the upper horizontal profile (10.3) of each of the two side frames (10), and the plate-shaped wall elements of the base group are installed between and/or on the lower horizontal frame profile (10.2) of each of the two side frames (10).

25. The cooling unit according to claim 9, wherein the evaporator (50, 50', 50") or other heat exchanger is fastened to the intermediate wall (12.2).

26. The cooling unit according to claim 1, wherein spaced apart from and in front of vertical frame profiles (10.1), vertical support profiles (10.4) are installed between lower and upper horizontal frame profiles (10.2, 10.3) by a thermally insulating connection.

27. The cooling unit according to claim 12, wherein a cooling unit system of a plurality of the cooling units aligned next to one another and embodied in the form of shelving modules (1, 2, 3), wherein transitions between the shelving modules (1, 2, 3) along the adjacent narrow edges of at least the plate-shaped wall elements of the rear wall group (12) are sealed by inserting sealing components; and the shelving modules (1, 2, 3) are screwed to one another in adjacent frame profiles.

28. The cooling unit of claim 1, further comprising at least one second fan (57) in the outer vertical flow conduit (12.5) to produce an air flow through the outer flow conduit.

29. The cooling unit according to claim 1, further comprising a cooling air baffle plate (12.40) extending downward from the fans (56) toward the cooling chamber (4), wherein a first partial flow of the air flow from the fans is directed upward into the upper intermediate space 13.7 and a second partial flow of the air flow from the fans is directed downward on an inside surface of the cooling air baffle plate (12.40) that is disposed toward the cooling chamber (4).

30. The cooling unit according to claim 28, wherein the at least one second fan (57) is in a lower region of the outer vertical flow conduit (12.5) below the evaporator (50, 50', 50") or other heat exchanger.

* * * * *